US005617105A

United States Patent [19]

Tsunekawa et al.

[11] Patent Number: 5,617,105

[45] Date of Patent: Apr. 1, 1997

[54] ANTENNA EQUIPMENT

[75] Inventors: Koichi Tsunekawa; Seiji Hagiwara, both of Yokosuka, Japan

[73] Assignee: NTT Mobile Communications Network, Inc., Tokyo, Japan

[21] Appl. No.: 311,160

[22] Filed: Sep. 23, 1994

[30] Foreign Application Priority Data

| | | | |
|---|---|---|---|
| Sep. 29, 1993 | [JP] | Japan | 5-243207 |
| Oct. 13, 1993 | [JP] | Japan | 5-255974 |
| Oct. 13, 1993 | [JP] | Japan | 5-255986 |
| Feb. 9, 1994 | [JP] | Japan | 6-015134 |

[51] Int. Cl.[6] ..... H01Q 1/24; H01Q 1/36; H01Q 21/00

[52] U.S. Cl. ..... 343/702; 343/895; 343/901; 343/725; 343/791

[58] Field of Search ..... 343/702, 895, 343/900, 901, 790, 791, 792, 767, 770, 725, 729; H01Q 1/24, 1/36, 21/00

[56] References Cited

U.S. PATENT DOCUMENTS

| | | | |
|---|---|---|---|
| 2,418,961 | 4/1947 | Wehner | 343/791 |
| 3,798,654 | 3/1974 | Martino et al. | 343/745 |
| 3,945,013 | 3/1976 | Brunner et al. | 343/708 |
| 4,494,122 | 1/1985 | Garay et al. | 343/722 |
| 4,868,576 | 9/1989 | Johnson, Jr. | 343/702 |
| 5,317,325 | 5/1994 | Bottomley | 343/702 |
| 5,353,036 | 10/1994 | Baldry | 343/895 |
| 5,389,938 | 2/1995 | Harrison | 343/702 |
| 5,465,098 | 11/1995 | Fujisawa et al. | 343/718 |

FOREIGN PATENT DOCUMENTS

| | | |
|---|---|---|
| 0511577 | 4/1992 | European Pat. Off. . |
| 55-165004 | 12/1980 | Japan . |
| 61-125204 | 6/1986 | Japan . |
| 62-098804 | 5/1987 | Japan . |
| 62-213303 | 9/1987 | Japan . |
| 1-170201 | 7/1989 | Japan . |
| 2219911 | 12/1989 | United Kingdom . |
| 2257836 | 1/1993 | United Kingdom . |
| 84/02614 | 7/1984 | WIPO . |

*Primary Examiner*—Hoanganh T. Le
*Attorney, Agent, or Firm*—Pollock, Vande Sande & Priddy

[57] ABSTRACT

A rod antenna element is connected at its lower end to one end of a coaxial impedance converter, the other end of which is connected to a feeder. A coil antenna element is capacitively coupled to the rod antenna element to provide a double resonance characteristic. When held at its retracted position, the rod antenna element, inserted in an outer conductor of the coaxial impedance converter, may preferably form an inner conductor larger in diameter than that when the rod antenna element is at its extended-out position, and the rod antenna element is connected to a coil antenna element with a low impedance.

31 Claims, 30 Drawing Sheets

FIG. 11A
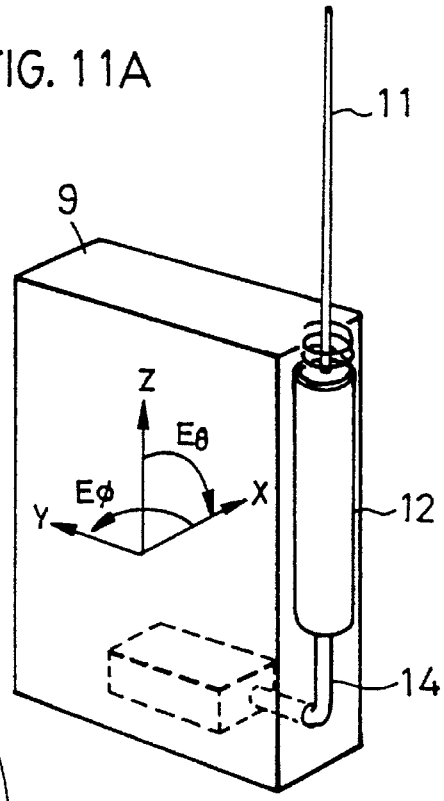
FIG. 11B
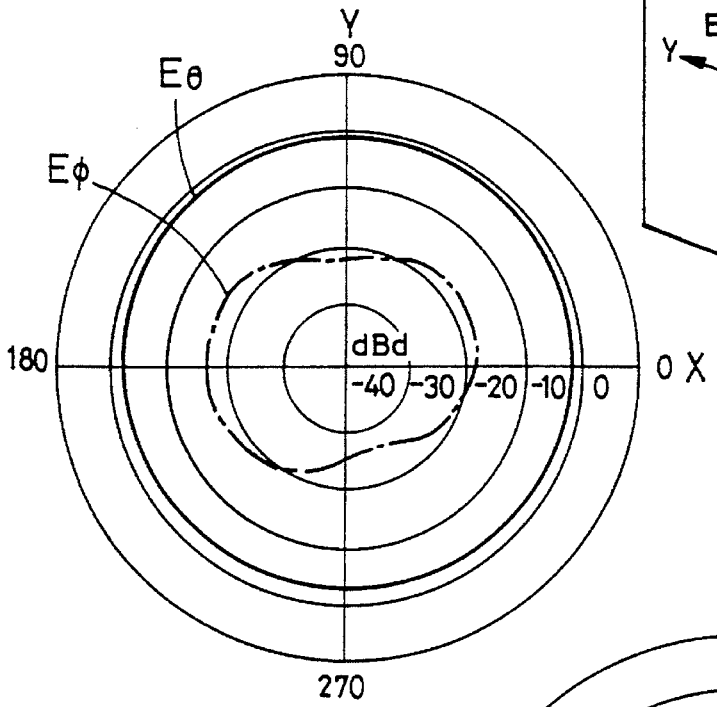
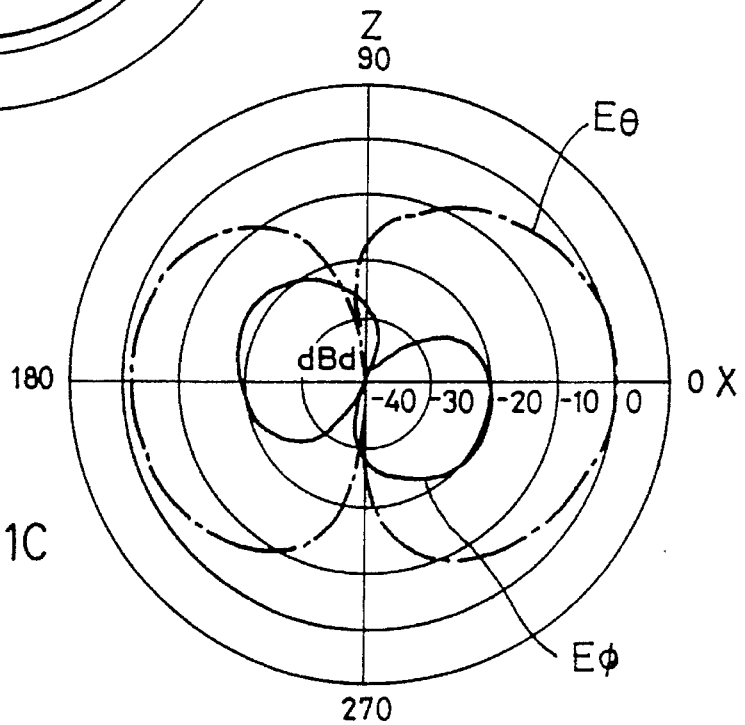
FIG. 11C

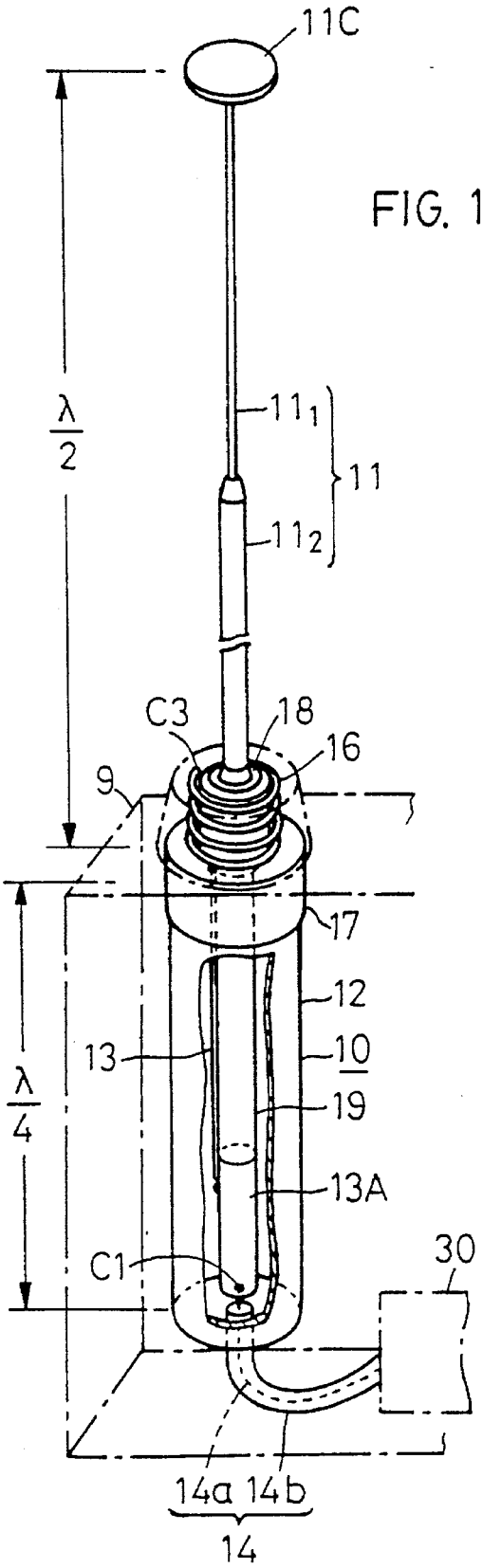
FIG. 14A
FIG. 14B
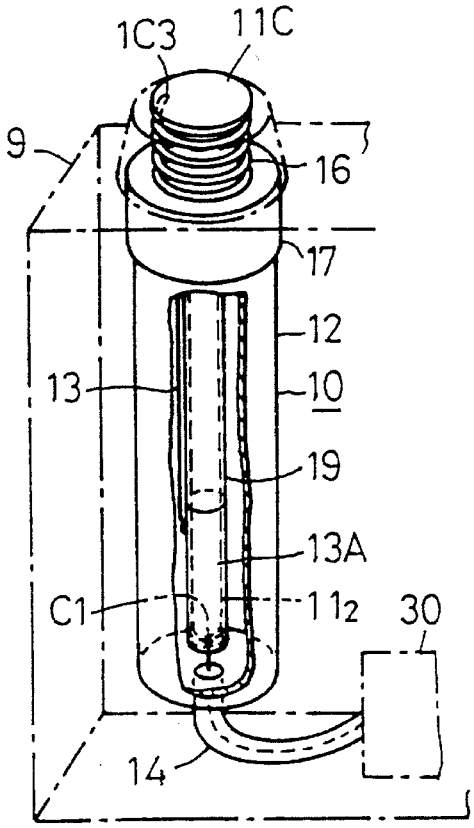

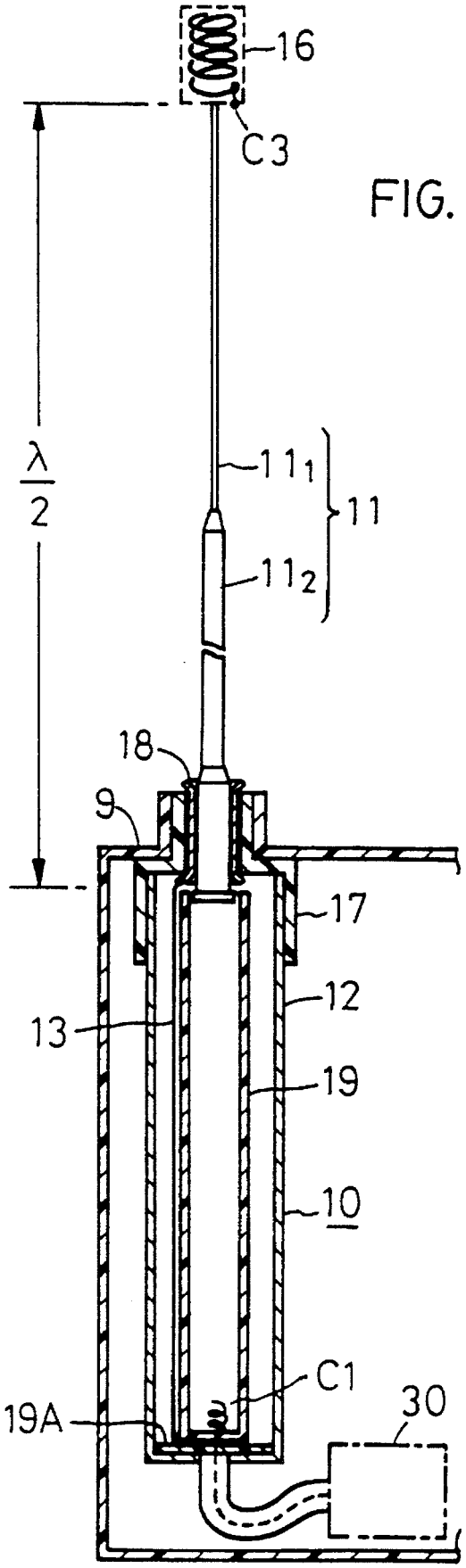
FIG. 18A
FIG. 18B
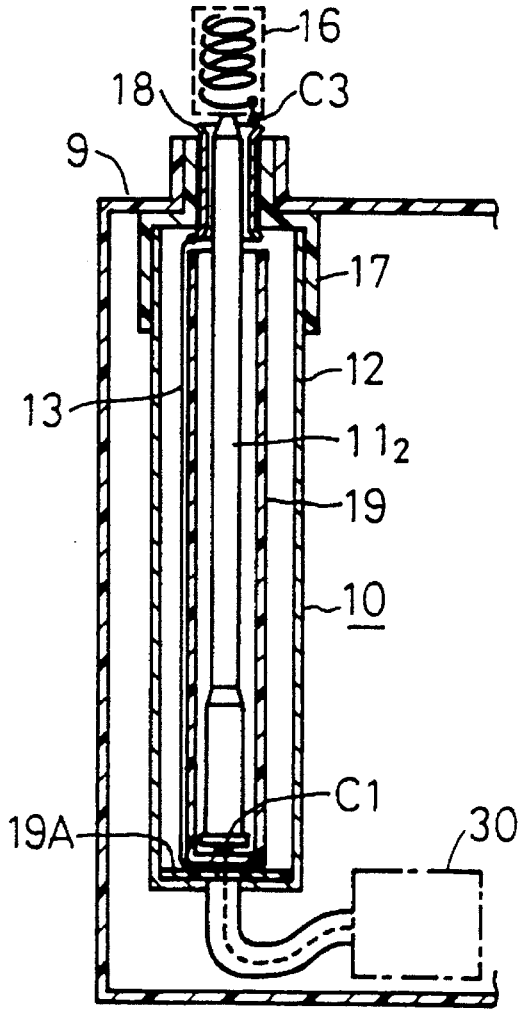

ANTENNA EQUIPMENT

BACKGROUND OF THE INVENTION

The present invention relates to antenna equipment for use with automobile, portable and cordless telephones and other mobile station radio units.

The mobile radio communication network has been steadily extended to meet a growing demand for daily use and cannot be accommodated in a single frequency band conventionally assigned thereto; now, it is assigned one more frequency band. It is desired, therefore, that every mobile station equipment be switchable between these two frequencies—this calls for an antenna equipment that resonates with two different frequencies. FIGS. 1 and 2 show prior art examples of such an antenna equipment adapted for resonance with two frequencies. In the example of FIG. 1 a resonance circuit 7 is provided at a midpoint in an antenna element 11 and has a resonance frequency different from that of the antenna element 11, and besides, a matching circuit 8 is connected between a feeder 14 and the antenna element 11 to match their impedances. In the example of FIG. 2 the matching circuit 8 between the antenna element 11 and the feeder 14 is adapted to resonate with two frequencies.

In the unit of FIG. 1 the matching circuit 8 is relatively simple in structure but the provision of the resonance circuit 7 at a midpoint in the antenna element 11 introduces complexity in the mechanical structure of the antenna equipment, and in general, the antenna element 11 readily becomes crimped at that portion. In the example of FIG. 2 the matching circuit 8 is complex in structure and the provision of such a complicated matching circuit 8 will increase the power loss or dissipation by the antenna circuit accordingly. Besides, in the prior art examples of FIGS. 1 and 2 an antenna current develops in an antenna housing 9 (indicated by a symbol of ground potential); consequently, in a radio unit of the type wherein the housing is held by hand, the current distribution varies with how the housing is held and with the movement of the human body, causing a change in the radiation characteristic of the antenna. Furthermore, the antenna characteristic itself is also affected by the shape and material of the housing and parts mounted thereon (such as a dial pad and a liquid crystal display screen).

In Japanese Patent Application Laid-Open No. 213303/87 there is disclosed an antenna equipment of a construction in which a coaxial line of a length $\lambda/4$ ($\lambda$ being the wavelength used) and a characteristic impedance $Z_0$ is connected between the feeding point of a $\lambda/2$ rod antenna and a feeder of a characteristic impedance Zb, and the impedance Za of the antenna feeding point and the impedances Zb and $Z_0$ of the above-mentioned feeder and coaxial line are selected such that $|Z_0|=(ZaZb)^{1/2}$, thereby implementing the intended impedance matching. The antenna equipment of the above construction is capable of achieving high gains for wavelengths which are integral multiples of $\lambda/2$; besides, since the impedance of the antenna feeding point is very high (infinite, theoretically), the antenna current flowing to the housing is limited, and consequently, the dependence of the antenna characteristic on the housing structure is low and even if the housing is held by hand, the radiation characteristic of the antenna does not appreciably change. With the above-described antenna structure, however, a second operating wavelength is limited to integral multiples of $\lambda/2$ in contrast to the first wavelength $\lambda$, and hence it cannot freely be chosen. Moreover, it is difficult to achieve high gains for two wave-lengths which are relatively close to each other within $\lambda/2$ in the frequency band assigned to the mobile radio communication.

The portable radio telephone utilizes, in many cases, a telescopic antenna equipment of the type that the antenna element is extended out of the unit housing during communication but housed in the housing while not in use. In Japanese Patent Application Laid-Open No. 170201/89, for example, there is disclosed an antenna of a construction in which a first rod (0.6 $\lambda$) is received in a second rod (0.5$\lambda$), which is received in a third rod, which is, in turn, disposed inside a metal pipe, thus forming a $\lambda/2$ long impedance matching coaxial line. Such a telescopic antenna equipment facilitates carrying the radio telephone while not in use for communication, but the portable radio telephone needs to be held in the wait-receive mode in which to continue receiving electric waves from a base station at all times while not in use for communication, too. Hence, when the antenna element is retracted into and housed in the unit housing in the above-mentioned wait-receive mode, the impedance characteristic of the antenna will change, resulting in extreme reduction of its gain for received waves. In this instance, if the housing is made of metal, the sensitivity of the antenna will go down to substantially zero since it is covered with metal. Thus, it is impossible, in principle, to use such an antenna in its retracted state in the radio telephone that must be held in the wait-receive mode during the non-communication period. On the other hand, a diversity antenna requires two antenna elements, and hence is inevitably bulky.

SUMMARY OF THE INVENTION

An object of the present invention is to provide an antenna equipment which resonates with a plurality of frequencies and is simple-structured and low-loss and whose radiation characteristic resists being affected by the human body or unit housing.

Another object of the present invention is to provide an antenna equipment which, when retracted in the unit housing, has sensitivity to such an extent as to permit the wait-receive mode and whose radiation characteristic resists being affected by the human body or unit housing.

Still another object of the present invention is to provide an antenna equipment which is very small when formed for diversity reception too.

The antenna equipment according to a first aspect of the present invention comprises; a rod-like antenna element; a metal cylinder provided at one end of the antenna element, with their center axes held in alignment with each other; an inner conductor connected to one end of the antenna element and extended substantially along the center axis of the metal cylinder to form a coaxial line in combination therewith; and a coaxial feeder which has a core conductor connected to the inner conductor and an outer conductor connected to the metal cylinder at one end thereof opposite from the first antenna element. The coaxial line constitutes a coaxial type impedance converter and the metal cylinder has a part of its periphery cut out a predetermined length in its axial direction from one end at the side of the antenna element.

The antenna unit according to a second aspect of the present invention comprises: a rod-like first antenna element; a metal cylinder provided at one end of the first antenna element and axially aligned therewith; an inner conductor connected to one end to the first antenna element and extended substantially along the center axis of the metal cylinder to form a coaxial line in combination therewith; a coaxial feeder which has a core conductor connected to the inner conductor and an outer conductor connected to the metal cylinder at one end thereof opposite from the first antenna element; and a second antenna element coiled around a part of the first antenna element concentrically therewith and capacitively coupled thereto. The coaxial line constitutes a coaxial type impedance converter.

The antenna equipment according to a third aspect of the present invention comprises: a metal cylinder; an inner conductor extended in the metal cylinder along its center axis to form a coaxial line in combination with the metal cylinder; a rod-like first antenna element projecting out from the metal cylinder and retractable thereinto along its center axis; a sliding contact means which is connected to one end of the inner conductor and makes sliding contact with the first antenna element; a feeder which has a core conductor connected to the inner conductor and an outer conductor connected to the metal cylinder at one end thereof opposite from the first antenna element; and a second antenna element which is connected to the first antenna element when the latter is retracted in the metal cylinder. When the first antenna element is held projecting out from the metal cylinder, the second antenna element is out of contact with the first antenna element, and the metal cylinder and the inner conductor constitute a coaxial type impedance converter which provides the match between the first antenna element and the feeder and interconnects them.

The antenna equipment according to a fourth aspect of the present invention comprises: a rod-like antenna element; a metal cylinder provided at one end of the rod-like antenna element and axially aligned therewith; an inner conductor connected to one end of the rod-like antenna element and extended substantially along the center axis of the metal cylinder to form a coaxial line in combination therewith; a first feeder which has a core conductor connected to the inner conductor and an outer conductor connected to the metal cylinder at one end thereof opposite from the rod-like antenna element; a slot antenna formed by a slot cut in the metal cylinder in its axial direction; and a second feeder connected at one end to the slot antenna. The coaxial line constitutes a coaxial type impedance converter which provides the match between the rod-like antenna element and the first feeder and interconnects them.

BRIEF DESCRIPTION OF THE DRAWINGS

FIG. 11A is an external view of a radio unit equipped with the antenna equipment of the FIG. 8A embodiment, showing the direction of measurement;

FIG. 11B is a diagram showing the radiation pattern characteristic in the X-Y plane measured in the state shown in FIG. 11A;

FIG. 11C is a diagram showing the radiation pattern characteristic in the X-Z plane measured in the state shown in FIG. 11A;

FIG. 14A is a perspective view, partly in section, illustrating a modified form of the FIG. 12A embodiment in which the inner conductor of the coaxial type impedance converter is made partly thick;

FIG. 14B is a perspective view, partly in section, showing the FIG. 14A embodiment, with the antenna held at its retracted position;

FIG. 18A is a longitudinal sectional view illustrating a modified form of the FIG. 17A embodiment in which the coil antenna element is electrically isolated from the rod antenna element and the former is connected to the coaxial type impedance converter when the antenna is held at its extended-out position;

FIG. 18B is a longitudinal section view of the antenna equipment of FIG. 18A with the antenna held at its retracted position;

DESCRIPTION OF THE PREFERRED EMBODIMENTS

Figure 1:
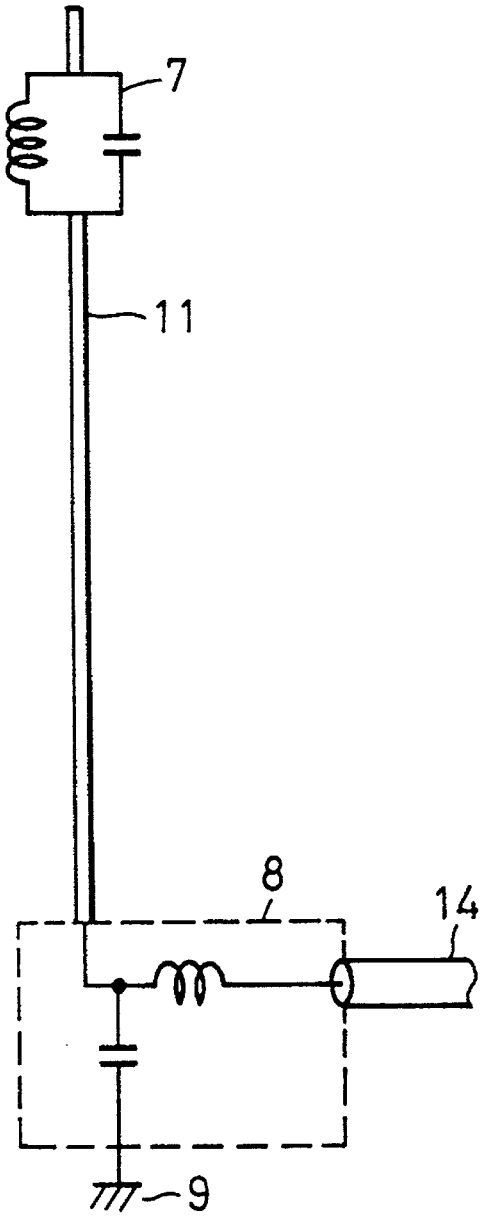
PRIOR ART FIG. 1
FIG. 1 is a diagram schematically showing an example of a conventional antenna equipment in which a resonance circuit is connected to a rod-like antenna element to provide two resonance points.
Figure 2:
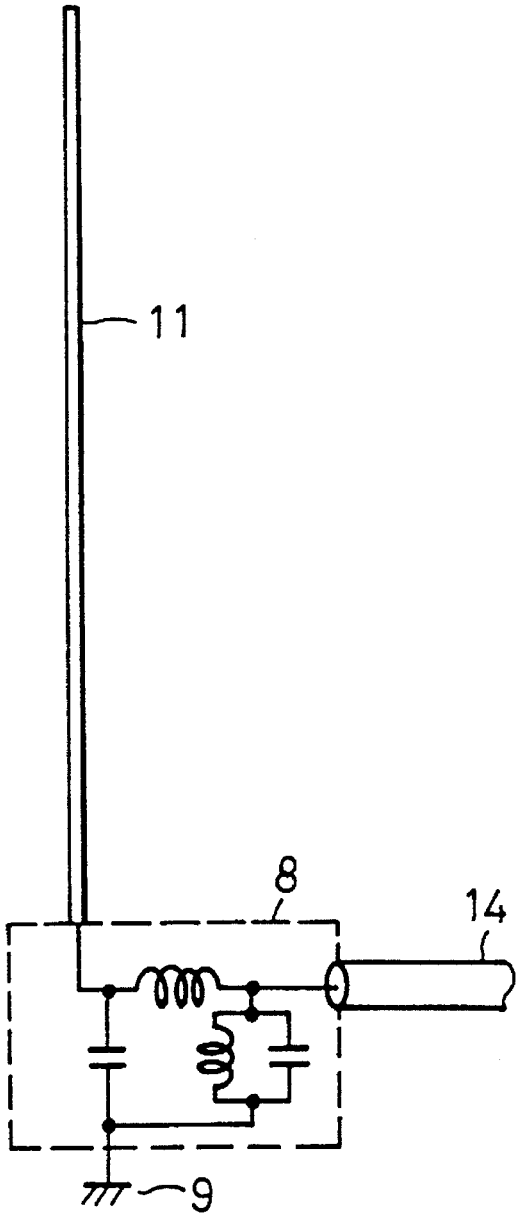
PRIOR ART FIG. 2
FIG. 2 is a diagram schematically showing an example of a conventional antenna equipment in which a resonance circuit is connected to a matching circuit connected to a rod-like antenna to provide two resonance points.
Figure 3A:
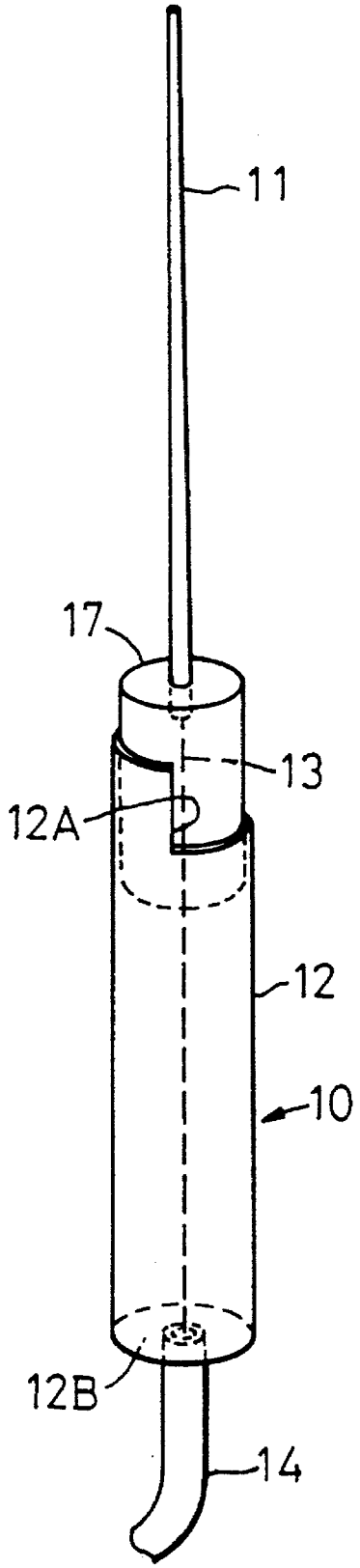
FIG. 3A is a perspective view illustrating an embodiment of the antenna equipment of the present invention in which the outer conductor of a coaxial type impedance converter is cut out half-way around it a predetermined length in its axial direction to effectively provide two pairs of different antenna lengths and coaxial line lengths.
Figure 3B:
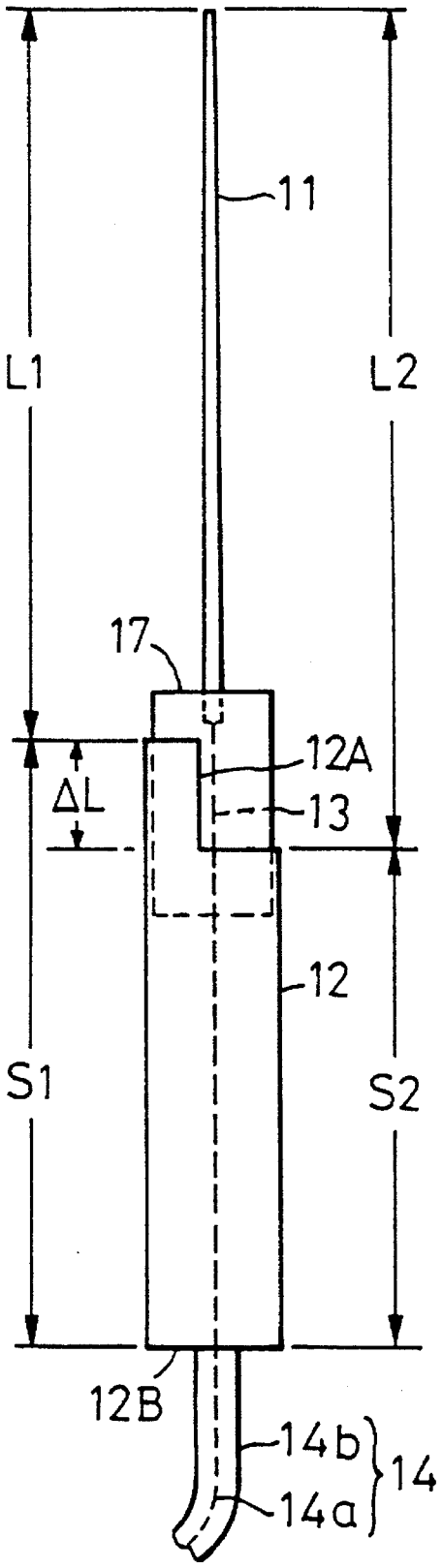
FIG. 3B is a front view of the antenna equipment depicted in FIG. 3A.

FIG. 3A illustrates, in perspective, an embodiment according to the first aspect of the present invention and FIG. 3B is its longitudinal sectional view. In this embodiment, a metal cylinder 12 is provided at the lower end of a rod antenna element 11, with their center axes aligned with each other, and a fine metal wire 13 is connected to the lower end of the rod antenna element 11 and extended substantially along the center axis of the metal cylinder 12; thus, there is formed a coaxial type impedance converter 10 composed of the metal cylinder 12 as an outer conductor and the fine wire 13 as an inner conductor. The lower end portion of the rod antenna element 11 and the upper end portion of the fine wire 13 connected thereto are embedded and held as one piece in a cylindrical insulating holder 17, which is forced into and fixed in the upper end portion of the metal cylinder 12. The metal cylinder 12 has a bottom plate 12B and the upper end portion of a coaxial feeder 14 is fixed to an aperture made in the bottom plate 12B centrally thereof. The feeder 14 has its outer conductor 14*b* electrically connected to the metal cylinder 12 through the bottom plate 12B and its core conductor 14*a* connected to the fine wire 12. The length of the metal cylinder 13 is chosen to be substantially equal to a quarter of the wavelength λ used. At the lower end of the metal cylinder 12 the core conductor 14*a* of the feeder 14 is connected to the fine wire 13 and the outer conductor 14*b* of the feeder 14 is connected to the metal cylinder 12. The length of the rod antenna element 11 is chosen to be substantially equal to one-half of the wavelength λ used and the rod antenna element 11 resonates with the operating frequency used.

The metal cylinder 12 has a semi-cylindrical notch 12A extending a length ΔL axially from its upper end and the notch 12A is defined by a plane containing the center axis of the metal cylinder 12 and a plane perpendicular thereto. By a proper selection of the characteristic impedance which depends on the lengths of the fine wire 13 and the metal cylinder 12 forming the inner and outer conductors of the coaxial line 10, respectively, and the ratio between the outer diameter of the fine wire 13 and the inner diameter of the metal cylinder 12, it is possible to form the coaxial line 10 as an impedance converter for the antenna element 11 and match its impedance to that of the feeder 14.

The provision of the notch 12A of the length ΔL enables this antenna equipment to serve both as an antenna which is formed by connecting to the rod antenna element 11 of a length $L_1$ to the coaxial type impedance converter 10 of the length $S_1$ and as an antenna which is formed by connecting a rod antenna element of a length $L_2=1_1+\Delta L$ to the coaxial impedance converter 10 of a length $S_2=S_1-\Delta L$.

Figure 4:
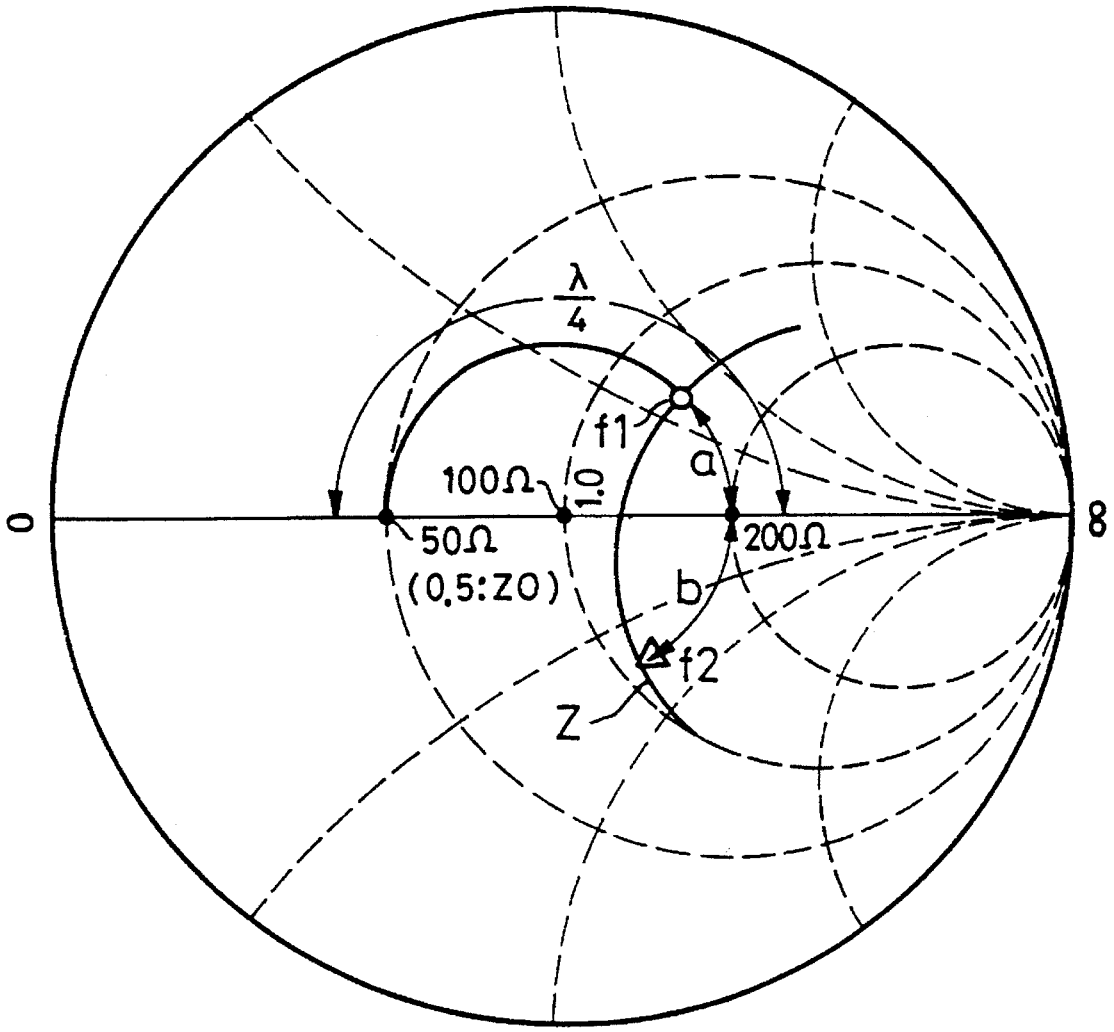
FIG. 4 is a Smith chart showing the concept of the coaxial type impedance conversion in the FIG. 3A embodiment.

FIG. 4 is a Smith chart showing the concept of impedance conversion. Reference character Z indicates the impedance characteristic of the antenna element 11. An ordinary 50–Ω series feeder is used as the feeder 14. The antenna element 11 has a length L nearly equal to λ/2 and a relatively high impedance characteristic and lays down a trail indicated by Z with respect to frequency. For example, to set the characteristic impedance of the coaxial line 10 to 100Ω, the ratio between the outer diameter of the fine wire 13 serving as the inner conductor and the inner diameter of the metal cylinder 12 serving as the outer conductor needs only to be made 6 or so; this could be done by using a conductor of a 1 mm diameter as the inner conductor 13 and selecting the inner diameter of the outer conductor 12 to be 6 mm.

In FIG. 4, the rated impedance Zo of the Smith chart is selected 100 Ω, and for the impedance characteristic of such a locus as indicated by Z, its points of intersection with a circle passing through a point where a pure resistance of 500 Ω (0.5:Zo) is provided are indicated by f1 and f2. The impedance at an antenna connection point at f1 and f2 can be matched to 50 Ω by selecting the length of the coaxial line 10 to be equal to this circular arc. In this instance, since the semicircle corresponds to λ/4 in terms of electrical length, it is possible to convert the impedance at the frequency f1 to 50 Ω and the impedance at the frequency f2 to 50 Ω by inserting a coaxial structure of a length (λ/4–a) and a coaxial structure of a length (λ/4+b) between the feeder 14 and the antenna element 11, respectively. To equip the coaxial impedance converter 10 with such two characteristics, the notch 12A shown in FIGS. 3A and 3B is provided in the metal cylinder 12; in this case, a desired double resonance characteristic could be obtained by properly selecting the lengths of the notch 12A in the circumferential and axial directions of the metal cylinder 12.

Thus, the coaxial impedance converter 10 has both characteristics based on the lengths $S_1$ and $S_2$ of the coaxial structure. By selecting the lengths $S_2$ and $S_1$ to be nearly equal to (λ/4–a) and (λ/4+b), respectively, it is possible to obtain a double resonance characteristic for resonance with frequencies f1 and f2. In this instance, a coaxial structure with a similar impedance conversion characteristic could be designed by properly selecting the characteristic impedance of the coaxial line 10 and the length ΔL of the notch 12A with respect to an arbitrary antenna impedance.

Figure 5A:
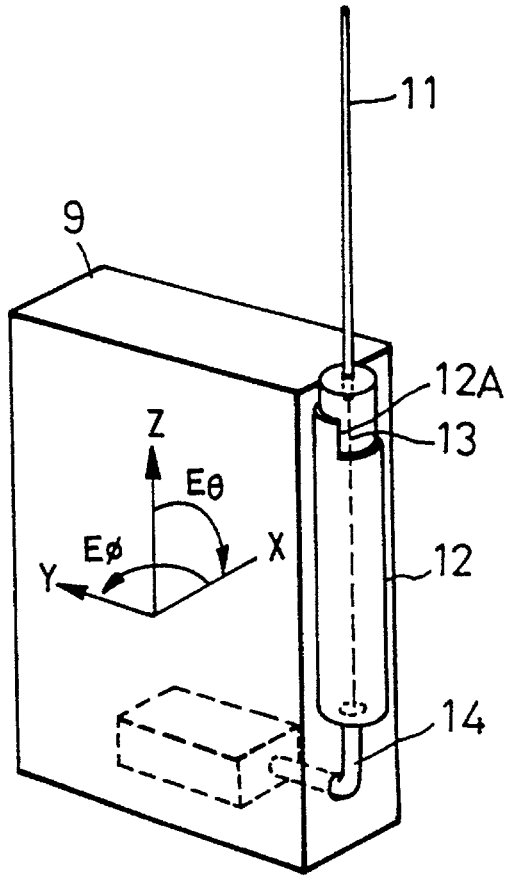
FIG. 5A is an external view of a radio unit equipped with the antenna equipment of the FIG. 3A embodiment.
Figure 5B:
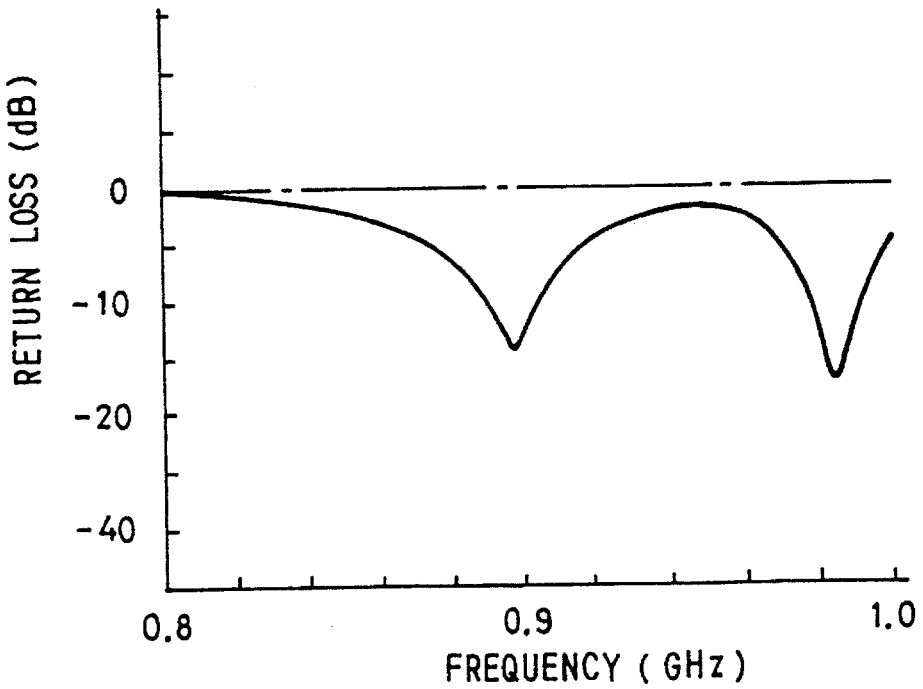
FIG. 5B is a graph showing the return-loss characteristic of the radio measured in the state shown in FIG. 5A.
Figure 5C:
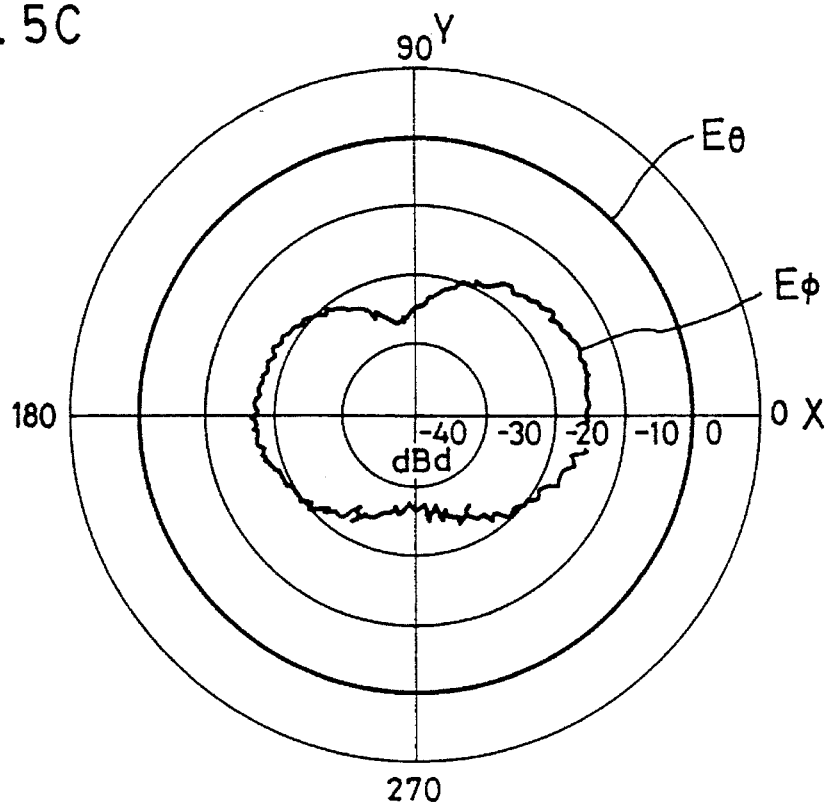
FIG. 5C is a diagram showing the radiation pattern characteristic in the X-Y plane measured in the state shown in FIG. 5A.
Figure 5D:
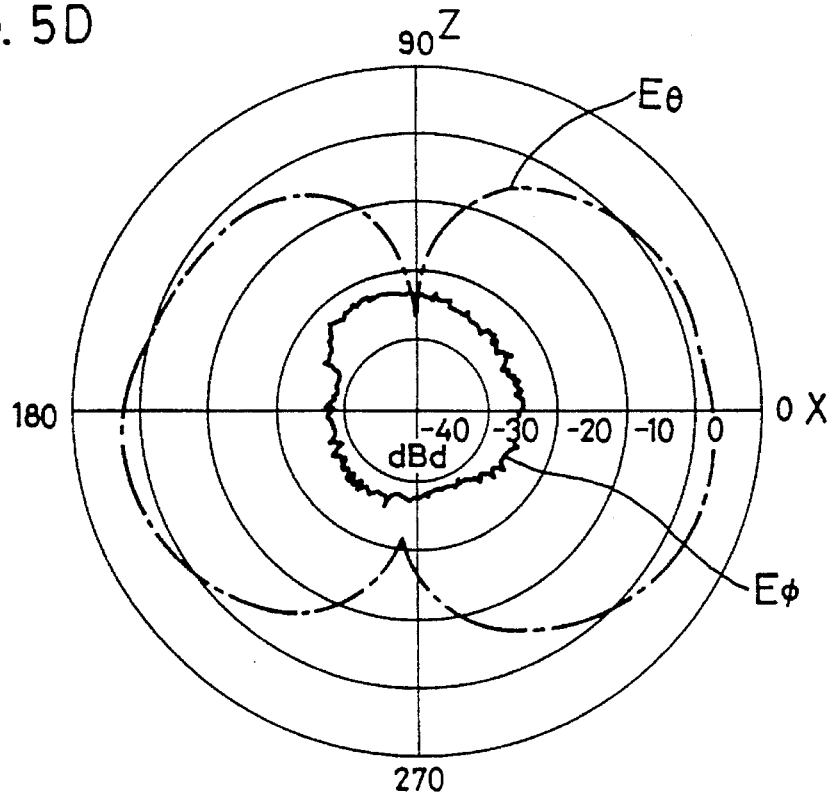
FIG. 5D is a diagram showing the radiation pattern characteristic in the X-Z plane measured in the state shown in FIG. 5A.

Now, a description will be given of the results of experiments conducted with the antenna equipment according to the first aspect of the invention which was mounted on a small housing. FIG. 5A is an external view schematically showing the experimental radio unit using the FIG. 3 embodiment; FIG. 5B is a graph showing the return loss (dB) of the antenna equipment measured in the state depicted in FIG. 5A; FIG. 5C is a diagram showing the radiation pattern characteristic of the antenna equipment in the X-Y plane of the radio unit; and FIG. 5D is a diagram showing the radiation pattern characteristic in the X-Z plane. In the experiments, the length of the metal cylinder 12 was about 8 cm, the length ΔL of the notch 12A was 2 cm, the length of the antenna element 11 was 15 cm, and the volume of the metal housing 9 was around 200 cc. In the experiments, a double resonance characteristic was obtained wherein the antenna equipment resonated at about 896 MHz and at 984 MHz was obtained. FIGS. 5C and 5D respectively show a θ-component E θ (the electric field intensity measured, with the polarization of the antenna for measurement held equal to the θ-direction vector) and a ϕ-component E ϕ (the electric field intensity measured, with the polarization of the antenna held equal to the ϕ-direction vector) of the receiving electric field of the antenna equipment. As seen from FIGS. 5C and 5D, although the antenna equipment was mounted on the small housing 9, the antenna element 11 was hardly influenced by the housing 9 and showed, at 984 MHz, the radiation pattern characteristic of its own; that is, the ϕ-component field intensity E θ traced a substantially circular pattern in the horizontal plane (the X-T plane) and a substantially 8-letter pattern in the vertical plane (the X-Z plane). The radiation level was also nearly equal to that of a half-wave dipole antenna (0 dB) and substantially no loss was detected.

Figure 6:
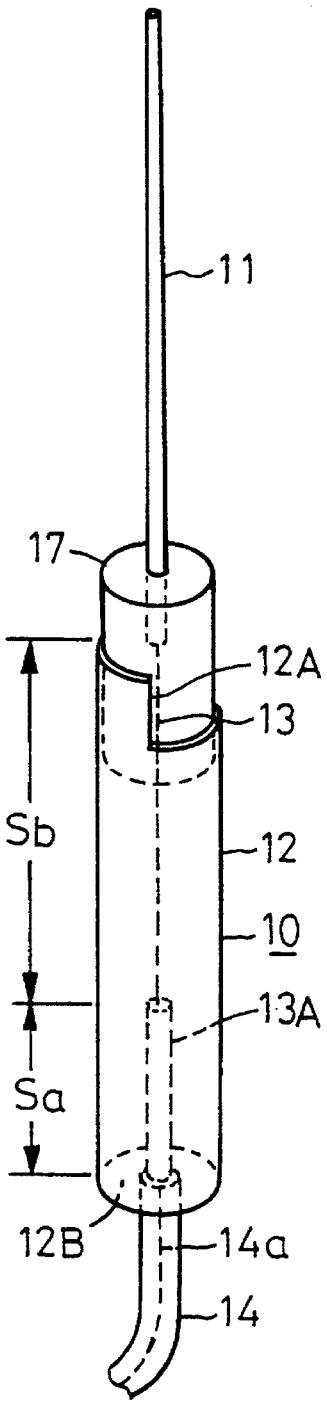
FIG. 6 is a perspective view illustrating a modified form of the FIG. 3A embodiment in which the inner conductor of the coaxial type impedance converter is made partly thick.

FIG. 6 is a perspective view illustrating a second embodiment according to the first aspect of the invention. This embodiment is identical in construction with the FIG. 3 embodiment except that a metal rod 13A of a diameter larger than that of the fine wire 13 is connected to the lower end of the latter over a length Sa along the center axis of the metal cylinder 12.

The coaxial line 10 of such a structure as shown in FIG. 6 provides different characteristic impedances over the metal rod 13A of the length Sa and over the fine wire 13 of the length Sb; hence, it is possible to obtain a triple resonance characteristic (a wide band characteristic) or freely set the length (Sa+Sb) of the metal cylinder 12. The reason for this is that the coaxial line 10 becomes a two-stage matching circuit by properly selecting the characteristic impedances and lengths of the cylindrical portions Sa and Sb. The two-stage matching circuit provides a wider frequency band than does a single-stage matching circuit and provides the double resonance characteristic as well. Thus, coupled with the double resonance characteristic obtained by the notch 12A, this antenna structure implements the 3-resonance characteristic.

On the other hand, by setting the lower end portion Sa of the metal cylinder 12 to a characteristic impedance of 50 Ω, only the upper portion Sb of the metal cylinder 12 operates virtually as an impedance matching circuit (an impedance converter); hence, the metal cylinder 12, though having the length Sa+Sb, permits the implementation of a coaxial matching circuit by the cylindrical portion of the length Sb. This is effective in maximizing the effect of a stub by the metal cylinder 12. That is, the stub produces the maximum effect when the length of the metal cylinder 12 is λ/4 but the length of the cylindrical portion Sb serving as the impedance converter cannot be limited to λ/4. Thus, the length Sa of the metal rod 13A needs only to be adjusted so that Sa+Sb=λ/4.

Figure 7:
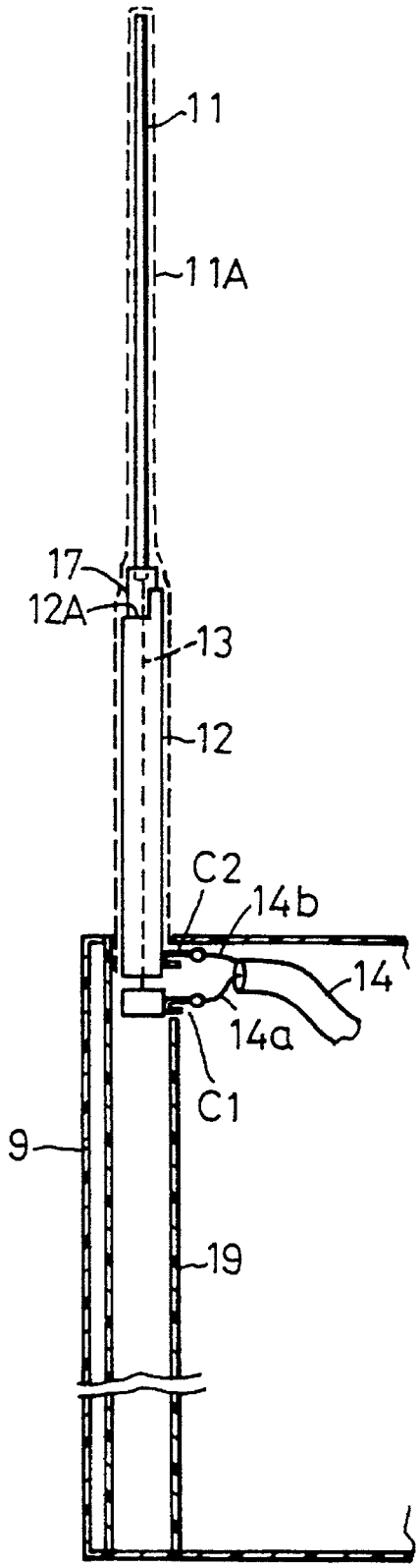
FIG. 7 is a longitudinal sectional view showing the state in which the antenna equipment of the FIG. 3A embodiment is retractably mounted on a housing.

FIG. 7 is a front view, partly in section, illustrating a third embodiment according to the first aspect of the invention. This embodiment is adapted so that the antenna element 11 in the FIG. 3 embodiment can be retracted in the radio housing 9. The antenna element 11 and the metal cylinder 12 are each clad with an antenna coating 11A, a contact C1 connected to the core conductor 14*a* of the feeder 14 is elastically connected to the fine wire 13 and a contact C2 connected to the outer conductor 14*b* of the feeder 14 is elastically connected to the metal cylinder 12. The whole antenna structure is guided into and received in an insulating guide tube 19 provided in the housing 9. This antenna structure appears to be a single rod antenna including the coaxial impedance converter and the antenna element but is identical in construction with the FIG. 3 embodiment and produces the same effect as that of the latter.

Figure 8A:
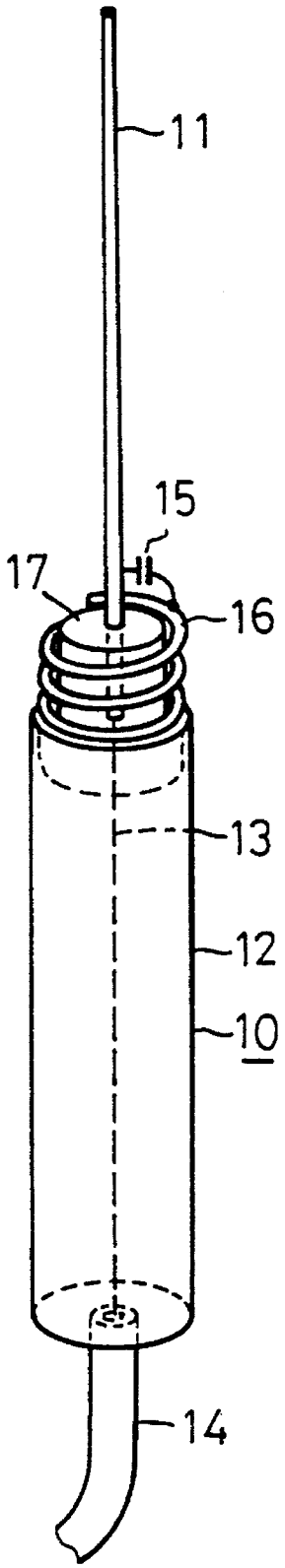
FIG. 8A is a perspective view illustrating another embodiment of the present invention in which a coil antenna element is capacitively coupled to a rod-like antenna element to provide a double resonance characteristic.
Figure 8B:
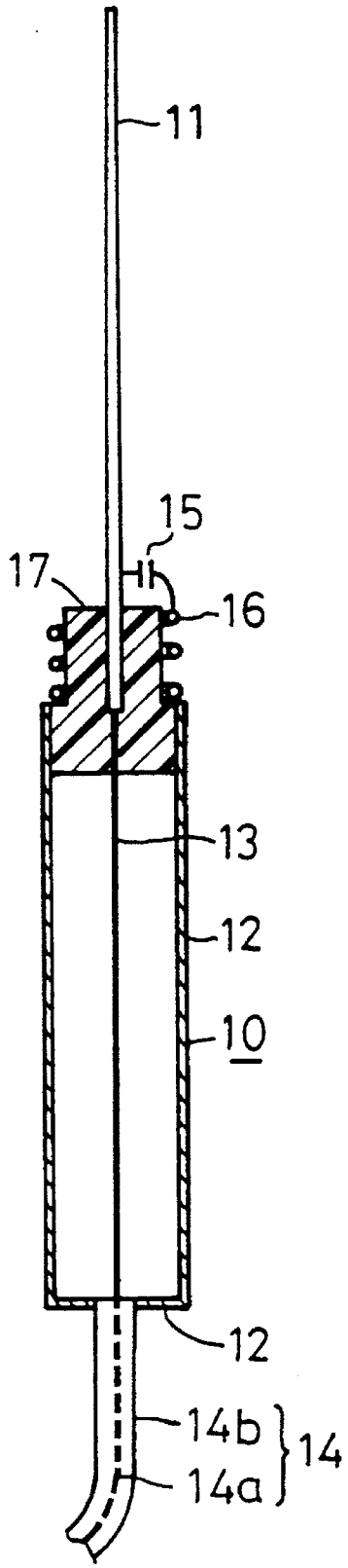
FIG. 8B is a longitudinal sectional view of the FIG. 8A embodiment.

FIG. 8A is a perspective view illustrating an embodiment according to the second aspect of the invention and FIG. 8B is a sectional view in its axial direction. In this embodiment, the metal cylinder 12 is provided at the lower end of the rod antenna element 11 with their center axes aligned with each other and the fine wire 13 is connected to the lower end of the rod antenna element 11 and extended substantially along the center axis of the metal cylinder 12. The lower end portion of the rod antenna element 11 and the upper end portion of the fine wire 13 are embedded and held as one piece in the cylindrical insulating holder 17, the lower end portion of which is fixedly received in the metal cylinder 12. The length of the metal cylinder 12 is about one-half the wavelength λ used. At the lower end of the metal cylinder 12, the core conductor 14*a* of the feeder 14 is connected to the fine wire 13 and the outer conductor 14*b* of the feeder 14 is connected to the metal cylinder 12. Thus, this embodiment is identical with the FIG. 3 embodiment in the above structural points, but in this embodiment, the metal cylinder 12 does not have the notch 12A. Instead of providing the notch 12A in the metal cylinder 12, a coil antenna element 16 is wound around the holder 17 in a manner to encircle the lower end portion of the antenna element 11 coaxially therewith and is connected at one end to the antenna element 11 via a capacitor 15. The coil antenna element 16 has substantially the same diameter as that of the metal cylinder 12.

The rod antenna element 11 has a length about one-half the wavelength λ used and resonates with the operating frequency. The capacitor 15 has its capacitance adjusted so that the resonance frequency, which is determined by the sum of the capacitance of the capacitor 15 and the stray capacitance between the coil antenna element 16 and the rod antenna element 11 and the inductance of the latter, has a desired value. In this case, by properly selecting dimensions of the coil antenna element 16 (such as the antenna diameter D, the coil pitch P, the number of turns T and the coil diameter ϕ), the desired resonance frequency could be obtained without using the capacitor 15.

In the embodiment according to the second aspect of the present invention, by setting the length of the rod antenna element 11 to λ/2, it is possible to achieve antenna gains higher than in the case of λ/4, as is the case with the FIG. 3 embodiment. On the other hand, the length of the coaxial line 10 composed of the fine wire 13 and the metal cylinder 12 is selected nearly equal to λ/4 to match the high impedance Za (infinite theoretically but usually hundreds of ohms) at the feeding point of the half-wave antenna and the low impedance (usually 50 ohms) of the feeder 14, and the characteristic impedance Zo, which depends on the ratio between the outer diameter of the fine wire 13 serving as the inner conductor and the inner diameter of the metal cylinder 12 serving as the outer conductor, is adjusted to that $Zo=(ZaZb)^{1/2}$. That is, the coaxial part (12, 13) functions as an impedance converter, making it possible to match the impedance Za of the antenna element 11 and the impedance Zb of the feeder 14. The antenna equipment of this embodiment has a resonance circuit made up of the coil antenna element 16 and the capacitor 15 and provided in parallel to the antenna element 11, and hence implements the double resonance characteristic, coupled with the resonance characteristic by the rod antenna element 11. Since the outer conductor of the coaxial impedance converter acts as a stub, the radiation characteristic of the antenna is not seriously affected by the housing 9 or the human body.

By properly selecting the dimensions of the coil antenna element 16 and the capacitance of the capacitor 15, the resonance frequency fr2 of the coil antenna element 16 can freely be set to be higher or lower than the resonance frequency fr1 of the rod antenna element 11. Various experimental values that provided desired resonance points are listed in the following tables, in which the length of the rod antenna element 11 is identified by $L_1$, the capacitance of the capacitor 15 by C, the diameter of the coil antenna element 16 by D, the number of turns of the coil by T, the pitch of the coil by P and the wire diameter of the coil by ϕ. In the experiments the coaxial part was 80 mm in length and 10 mm in outer diameter, the rod antenna element 11 was 1 mm thick and the antenna equipments were mounted on the housings of same size.

| Case (I) fr1 = 820 MHz < fr2 = 950 MHz | | | | | |
|---|---|---|---|---|---|
| $L_1$(mm) | C(cF) | D(mm) | T(mm) | P(mm) | ø(mm) |
| 158 | 0.5 | 7.4 | 4.7 | 1.2 | 0.8 |
| 158 | 0.5 | 10 | 2.8 | 1.4 | 0.8 |
| 158 | 0.5 | 6.8 | 5.5 | 1.1 | 0.8 |
| **Case (II) fr1 = 950 MHz < fr2 = 820 MHz** | | | | | |
| $L_1$(mm) | C(pF) | D(mm) | T(mm) | P(mm) | ø(mm) |
| 156 | none | 10 | 5.0 | 2 | 1 |
| 170 | 0.5 | 4.8 | 10 | 1.2 | 0.6 |
| 160 | 1.5 | 10 | 3.5 | 2 | 1 |

From the above, it is seen that the resonance point fr2 of the coil antenna element 16 can freely be set higher or lower than the resonance point fr1 of the rod antenna element 11 by properly selecting the dimensions of the coil antenna element 16 and the capacitance of the capacitor 15.

Figure 9A:
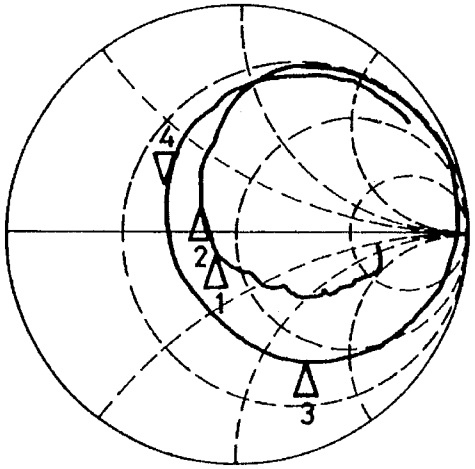
FIG. 9A is a Smith chart showing the impedance characteristic of the FIG. 8A embodiment when the resonance point of the coil antenna element was set higher than the resonance point of the rod antenna element.
Figure 9B:
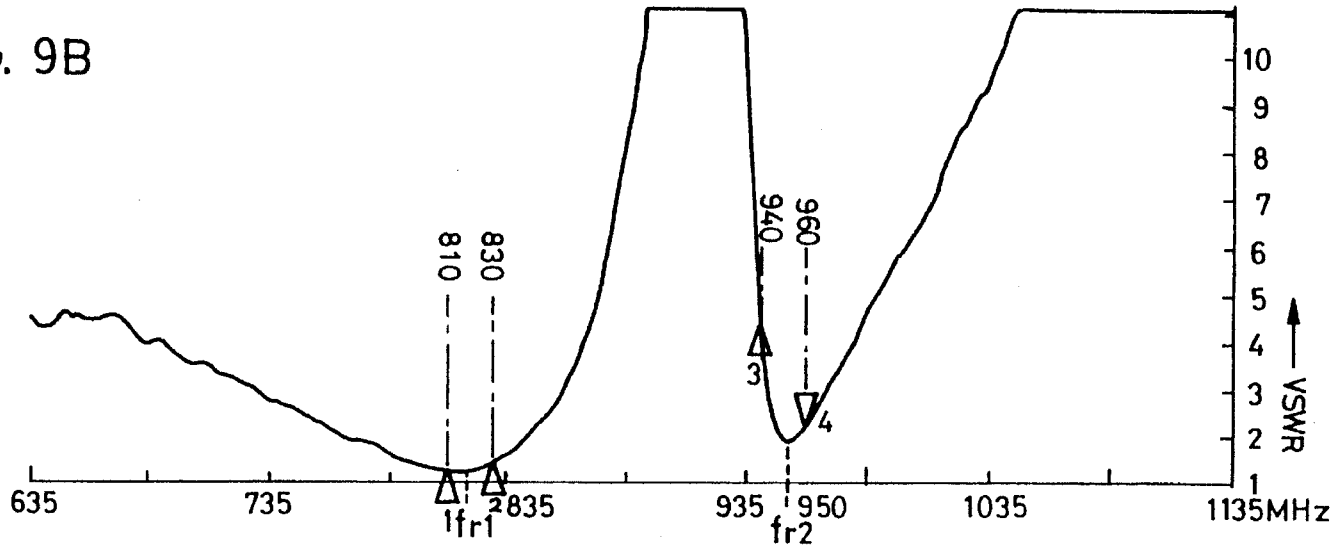
FIG. 9B is a graph showing its VSWR characteristic.
Figure 10A:
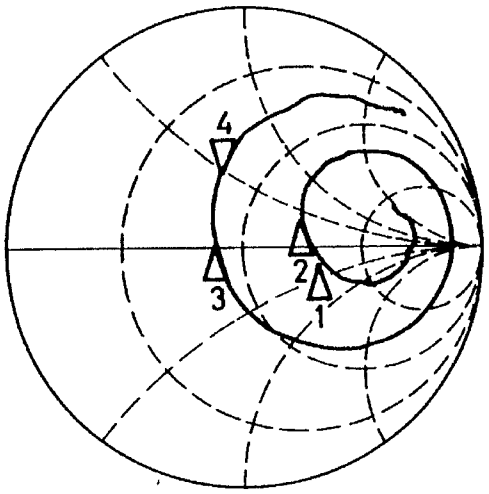
FIG. 10A is a Smith chart showing the impedance characteristic of the FIG. 8A embodiment when the resonance point of the coil antenna element was set lower than the resonance point of the rod antenna element.
Figure 10:
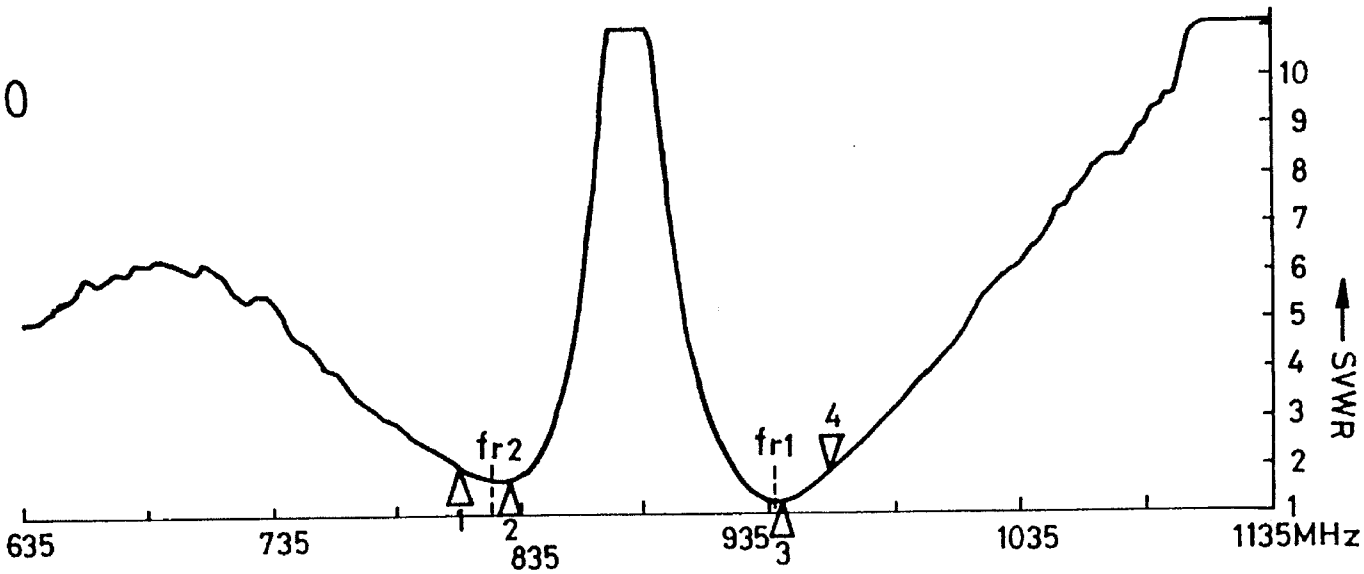
FIG. 10B is a graph showing its VSWR characteristic.

A Smith chart and a VSWR characteristic, which indicate the impedance characteristic of the antenna equipment of Case (I), are shown in FIGS. 9A and 9B, respectively, and a Smith chart and a VSWR characteristic diagram, which indicate the impedance characteristic of the antenna equipment of Case (II), are shown in FIGS. 10A and 10B, respectively. In either case, two resonance points were clearly obtained.

In FIGS. 11B and 11C there are shown radiation patterns of the θ- and ϕ-components E θ and E ϕ of the receiving electric field in the X-Y and X-Z planes measured at the resonance point fr1=950 MHz, with the antenna equipment of the FIG. 8 embodiment mounted on a housing 9 of a volume about 200 cc as shown in FIG. 11A. According to this embodiment, although the antenna equipment was mounted on the small housing 9, the radiation patterns each became substantially circular in the X-Y plane and substantially 8-letter shaped in the X-Z plane. The radiation level was about the same as that (0 dB) of a half-wave dipole antenna and substantially no loss was observed.

Figure 12A:
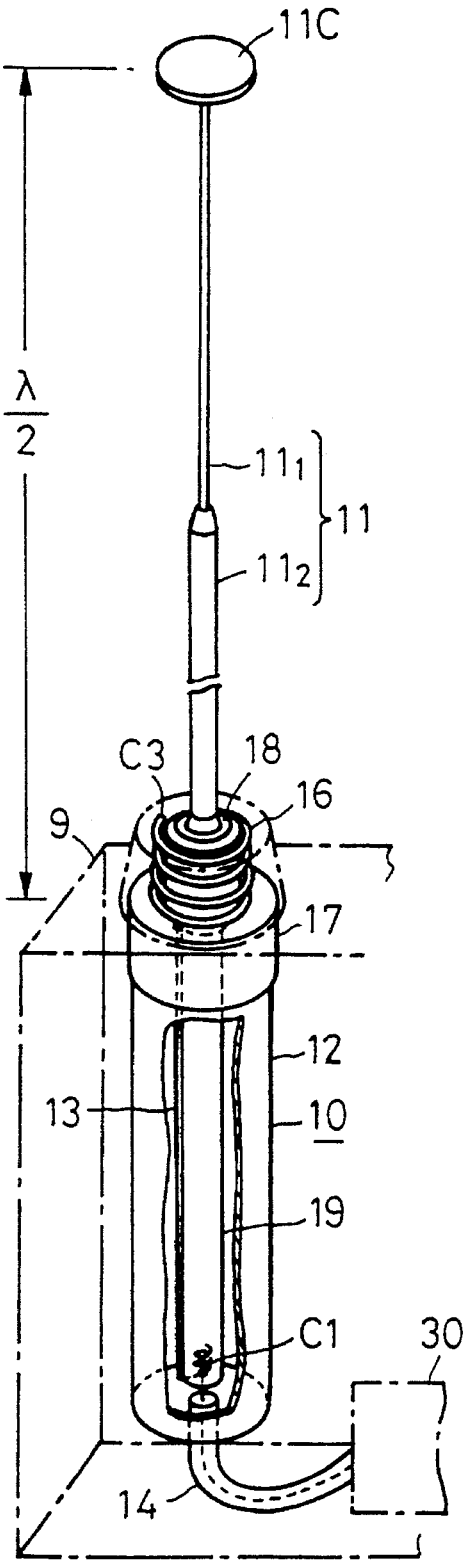
FIG. 12A is a perspective view, partly in section, illustrating another embodiment of the present invention in which a rod antenna element and a coil antenna element are adapted to selectively operate, depending upon whether the antenna is held at its extended-out or retracted position, and the matching state or level of the coaxial type impedance converter is changed correspondingly.
Figure 12B:
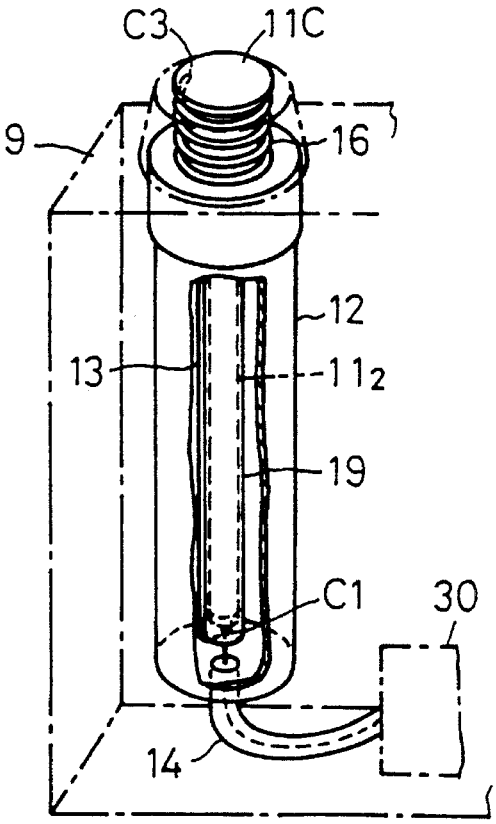
FIG. 12B is a perspective view, partly in section, showing the antenna equipment of FIG. 12A, with the antenna held at its retracted position.
Figure 12C:
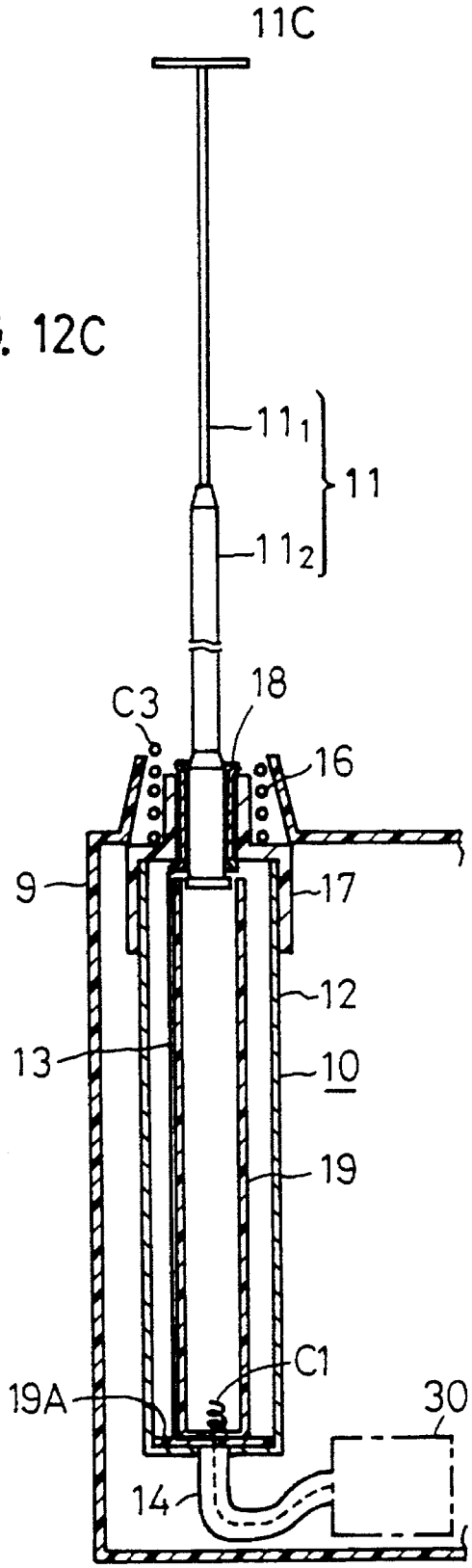
FIG. 12C is a longitudinal sectional view of FIG. 12A.
Figure 12D:
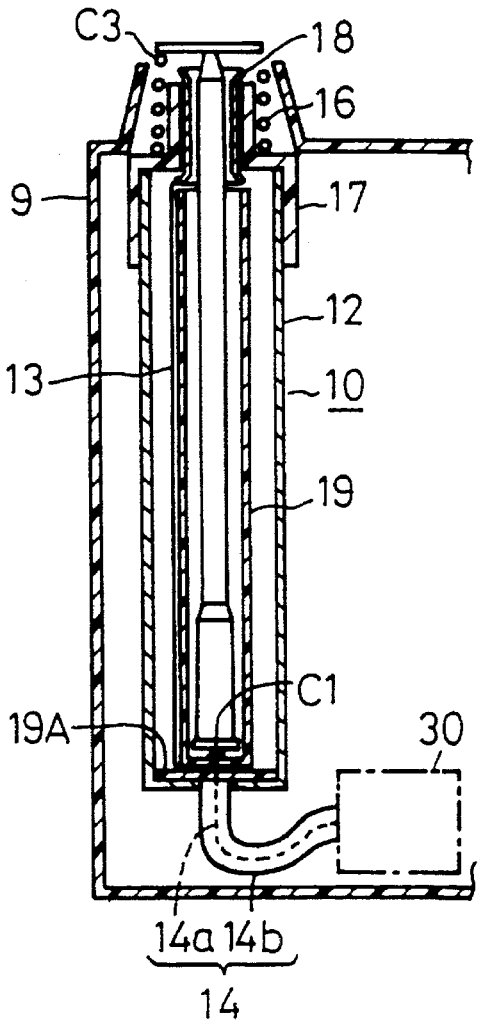
FIG. 12D is a longitudinal sectional view of FIG. 12B.

FIG. 12A is a perspective view illustrating an embodiment according to the third aspect of the invention, with the rod antenna element 16 pulled out from the housing 9, and FIG. 12B is a perspective view showing the state in which the rod antenna 11 is retracted in the housing 9. FIGS. 12C and 12D are longitudinal sectional views corresponding to FIGS. 12A and 12B. In this embodiment, the rod antenna element 11 is slidably received in the metal cylinder 12 along its center axis so that it may be pulled out therefrom as required. The fine wire 13 is extended substantially along the center axis of the metal cylinder 12, and in the lower end portion of the metal cylinder 12, the lower end of the fine wire 13 and the core conductor of the feeder 14 are interconnected. Provided immediately above the metal cylinder 12 is a ring-shaped contact metal member 18 which receives the rod antenna element 11 and makes sliding contact therewith and to which the top end of the fine wire 13 is connected. The coil antenna element 16 is disposed outside the contact metal member 18 concentrically therewith, and when the rod antenna element 11 is retracted in the metal cylinder 12, the upper end of the coil antenna element 16 makes elastic contact with a metal disc 11C mounted on the top of the antenna element 11.

To guide the rod antenna element 11 accurately along the axis of the metal cylinder 12, there is provided inside the metal cylinder 12 an insulating guide tube 19 coaxial therewith. The lower end of the insulating guide tube 19 is fixedly secured to an insulating support plate 19A (FIGS. 12C and 12D) fitted into the lower end portion of the metal cylinder 12 and the fine wire 13 is extended in the axial direction of the insulating guide tube 19 and fixed to the outside thereof. The rod antenna element 11 is composed of a thin or linear first rod 11 having the metal disc 11C at its tip and a tubular second rod $\mathbf{11}_2$ which receives therein the first rod $\mathbf{11}_1$. When guided into the insulating guide tube 19, the second rod $\mathbf{11}_2$ has retracted therein the first rod $\mathbf{11}_1$. The length of the rod antenna element 11 is substantially equal to $\lambda/4$ at its extended-out position. When the rod antenna 11 is at its extended-out position as shown in FIGS. 12A and 12C, it is necessary to match the 50-ohm impedance of the feeder 14 and an impedance of hundreds of ohms which is developed by feeding the half-wave rod antenna element 11 from its lower end. To perform this, a coaxial matching means (an impedance converter) is provided between the rod antenna element 11 and the feeder 14.

The coaxial structure is made up of the metal cylinder 12 of an about quarter-wave length, forming the outer conductor of the coaxial structure, and the fine wire 13 forming the inner conductor. To set the characteristic impedance Zo of the coaxial structure to, for example, around 200 ohms, a value close to $Zo=(ZaZb)^{1/2}$ where the impedance Zb of the feeder 14 is 50 ohms and the impedance Za of the rod antenna element 11 is hundreds of ohms, the diameter ratio of the inner and outer conductors needs only to be 6. For example, when the diameter of the inner conductor is 1 mm, the diameter of the outer conductor is 6 mm. In this embodiment, since the fine wire 13 forming the inner conductor is wired along the outside surface of the insulating guide tube 19 which receives the rod antenna 11, the inner conductor is off the center axis of the outer conductor; nevertheless, a proper characteristic impedance can be obtained. When the rod antenna element 11 is held at its projecting-out position, the coil antenna 16 is completely isolated and its resonance wavelength deviates from the operating wavelength; consequently, the coil antenna element 16 has no effect on the operating characteristic of the rod antenna 11 at that time.

When the rod antenna element 11 is retracted in the metal cylinder 12 as shown in FIGS. 12B and 12D, the core 14*a* of the feeder 14 is connected to the rod antenna element 11 via a coiled elastic contact terminal C1 provided on bottom of the insulating guide tube 19. At the same time, the tip of the coil antenna element 16, which forms an elastic contact terminal C3, makes elastic contact with the metal disc 11 of the rod antenna element 11, by which the coil antenna element 16 is connected to the rod antenna element 11. The coil antenna element 16 is designed to resonate with an impedance lower than does the rod antenna element 11. The rod antenna element 11, when retracted, functions as the inner conductor of the coaxial impedance converter 10. The rod antenna element 11 is larger in diameter than the fine wire 13 and the characteristic impedance of the coaxial structure goes low. For example, when the outer diameter of the rod antenna element 11 is 3 mm and the inner diameter of the metal cylinder 12 is 6 mm, the characteristic impedance of the coaxial structure of about 50 ohms. In this instance, the coaxial structure formed by the metal cylinder 12 and the rod antenna element 11 retracted therein operates as a mere 50-ohm transmission line, not as the impedance converter, and it is connected via the elastic contact terminal C3 to the coil antenna element 16 which operates with a low impedance. In this situation, the rod antenna element 11 does not ever exert any influence on the operating characteristic of the coil antenna element 16.

When the rod antenna element 11 is held at its pulled-out position, the coaxial structure 10 serves as an impedance converter as described above, and consequently, received power can efficiently be provided onto the feeder 14 from the high-impedance rod antenna element 11 which operates with a high gain as a half-wave antenna. On the other hand, when the rod antenna element 11 is retracted in the metal cylinder 12, the coaxial structure 10 performs the function of a 50-ohm transmission line as an extension of the feeder 14, and hence received power can efficiently be taken out from the low-impedance coil antenna element 16 which operates as a quarter-wave antenna.

While in the above the rod antenna element 11 has a length substantially equal to the half-wave length and the metal cylinder 12 a length equal to the quarter-wave length, the length of the rod antenna element 11 may also be chosen at will, in which case the length and characteristic impedance of the coaxial structure 11 need only to be selected appropriately. Also in this embodiment, when the rod antenna element 11 is held at the pulled-out position, the metal cylinder 12 acts as a stub and prevents a current flow to the casing 9, and hence the rod antenna element is hardly affected by the casing on which the antenna equipment is mounted; furthermore, since the coaxial impedance converter formed by distributed constant is used as the matching circuit, the bandwidth is wide and high gains can be obtained.

Figure 13A:
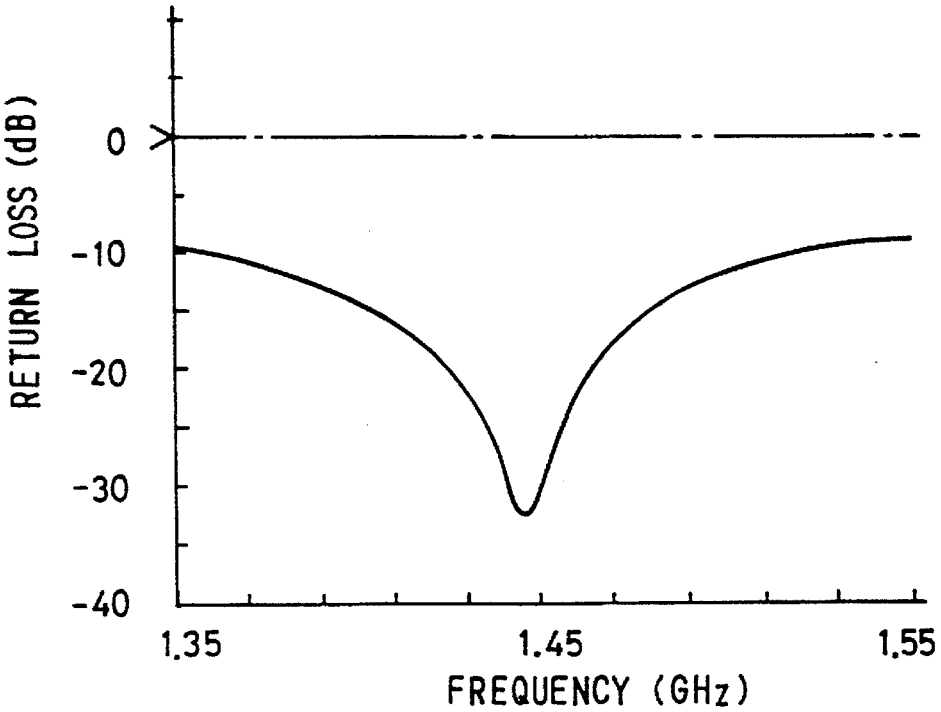
FIG. 13A is a graph showing the impedance characteristic of the FIG. 12A embodiment when the antenna is held at its extended-out position.
Figure 13B:
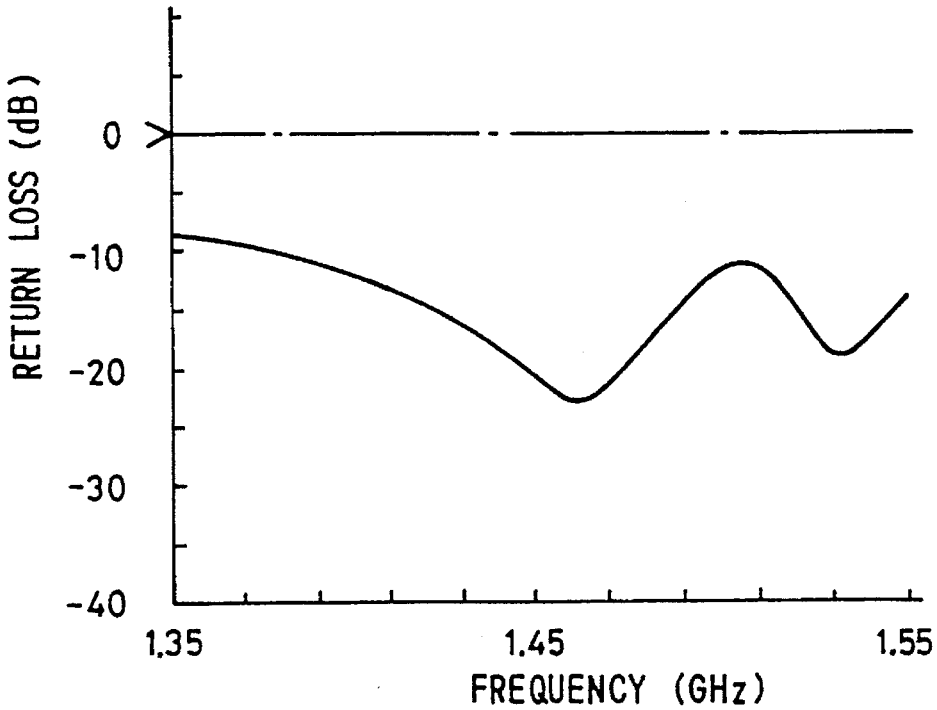
FIG. 13B is a graph showing the impedance characteristic of the FIG. 12A embodiment when the antenna is held at its retracted position.

In FIGS. 13A and 13B there are shown impedance characteristics of the coaxial impedance converter 10 measured when the rod antenna element 11 was held at its pulled-out and retracted positions in the FIGS. 12A, 12B embodiment. The metal cylinder 12 was 5 cm in length and 1 cm in diameter; the rod antenna element 11 was 10 cm long; the coil antenna element 16 was 1 cm in diameter and its number of turns was 2.5; and the antenna equipment was mounted on a metal casing of a volume about 200 cc. As seen from FIGS. 13A and 13B, the antenna equipment resonated at 1.44 GHz when the rod antenna element 11 was at the pulled-out position and at 1.46 GHz when the antenna rod 11 was at the retracted position; that is, the antenna equipment resonated at about the same frequency. This reveals that when the rod antenna element 11 is at the extended-out position, it is 10 cm long and functions as a half-wave antenna and that when the rod antenna 11 is at the retracted position, the coil antenna element 16 serves as a quarter-wave antenna because its length is about 2.5 cm. From this, it is seen that the characteristic impedance of the coaxial impedance converter changes with the position of the rod antenna element 11 and that received power at each resonance point can efficiently be taken out. The receiving bandwidth in the case of the rod antenna element 11 being at the pulled-out position is 150 MHz with VSWR<2 and the specific bandwidth is as wide as more than 10%, and the gain is also about the same as that of a half-wave dipole antenna.

FIG. 14A illustrates, in perspective, a second embodiment according to the third aspect of the invention, with the rod antenna element 11 held at the extended-out position, and FIG. 14B also illustrates, in perspective, the state in which the rod antenna element 11 is retracted. This embodiment is identical in construction with the FIG. 12 embodiment except that a conductive pipe 13A is fitted in the lower end portion of the nonconductive guide tube 19 coaxially therewith.

The conductor pipe 13A has about the same diameter as that of the insulating guide tube 19 which receives therein the rod antenna element 11. The conductor pipe 13A has its lower end connected to the inner conductor 14*a* of the feeder 14 and its upper end connected to the fine wire 13. When the rod antenna element 11 is at the retracted position, the lower end portion of the its second rod $\mathbf{11}_2$ is inserted in the conductor pipe 13A and constitutes the inner conductor of the low impedance coaxial line in combination with the conductor pipe 13A. At this time, the contact terminal C3 of the coil antenna element 16 is connected via the metal disc 11C to the inner conductor of the coaxial line 10 as in the case of the FIG. 12 embodiment. When the rod antenna element 11 is held at the extended-out position, the coaxial structure 10 using the metal cylinder 12 as the outer conductor is made up of a part using the fine wire 13 as the inner conductor and a part using as the inner conductor the conductor pipe 13A connected in series to the fine wire 13. Since the two parts have different characteristic impedances, the impedance converter can be designed with a higher degree of freedom. That is, the provision of such a two-stage impedance converter allows ease in achieving the double resonance characteristic and permits widening the band of the antenna characteristic.

When the characteristic of the part using the conductor pipe 13A as the inner conductor is set to 50 ohms, only the part in which the fine wire 13 serves as the inner conductor operates as an impedance converter; thus, it is possible to change the length of the impedance converter part alone while holding the length of the metal cylinder 12 unchanged at the quarter-wave length. Also in this instance, when the rod antenna element 11 is held at the retracted position, the conductor pipe 13A and the second rod $\mathbf{11}_2$ received therein form a unitary structure with each other. This state is identical with that shown in FIGS. 12B and 12D and the principle of operation is also the same. Thus, the FIG. 14 embodiment achieves high gains regardless of whether the rod antenna element 11 is at the extended or retracted position and implements a wide band characteristic.

Figure 15A:
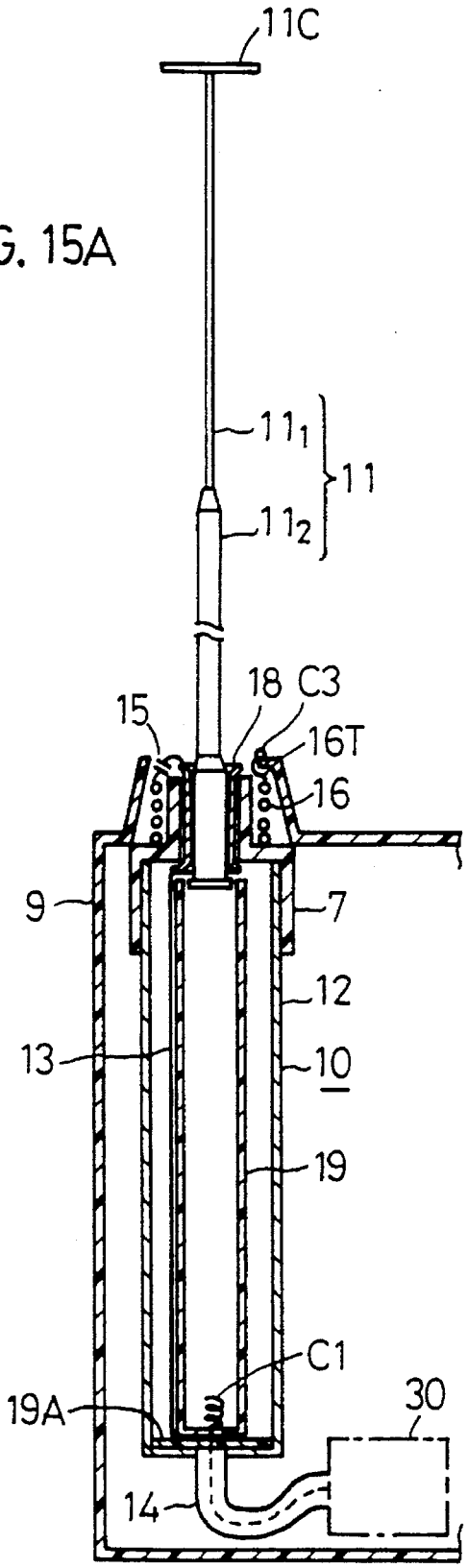
FIG. 15A is a longitudinal sectional view illustrating another modified form of the FIG. 12A in which the coaxial type impedance converter is connected to an intermediate tap of the coil forming the coil antenna element when the antenna is held at the retracted position.
Figure 15B:
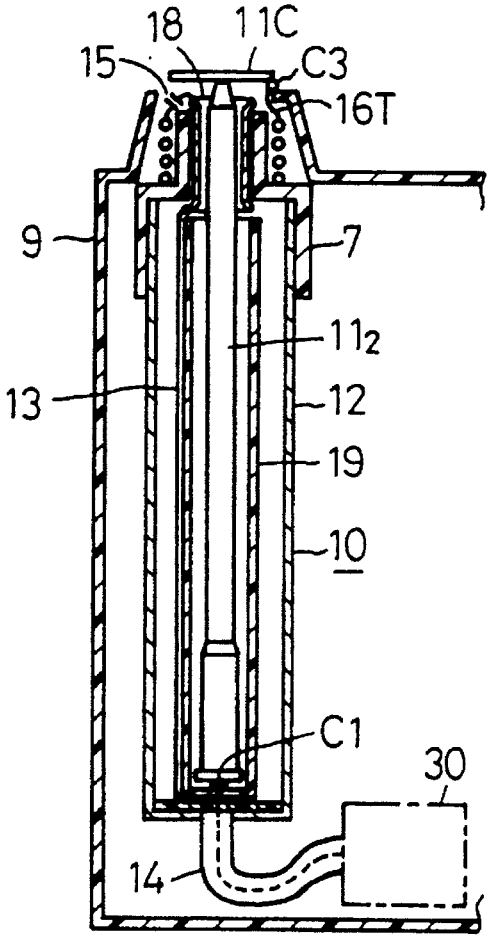
FIG. 15B is a longitudinal sectional view showing the antenna equipment of FIG. 15A, with the antenna held at its retracted position.

FIG. 15A is a longitudinal sectional view, partly in section, of a third embodiment according to the third aspect of the invention, with the rod antenna element 11 held at the extended position, and FIG. 15B is a longitudinal sectional view showing the state in which the rod antenna element 11 is at the retracted position. This embodiment is identical in construction with the FIG. 12 embodiment except that the contact terminal C3 is connected to an intermediate tap 16T of the coil forming the coil antenna element 16 and the capacitor 15 is connected between the top end of the coil antenna 16 and the ring-shaped contact metal member, as required. Accordingly, when the rod antenna element 11 is retracted in the metal cylinder 12, the tap 16T of the coil antenna element 16 makes contact with the metal disc 11C mounted on the tip of the rod antenna element 11.

When the rod antenna element 11 of the two-stage structure formed by the first and second rods $\mathbf{11}_1$ and $\mathbf{11}_2$ is at the extended position, its length is about $\lambda/4$ and the length of the metal cylinder 12 is about $\lambda/4$. With such a structure of this embodiment, when the rod antenna element 11 is at the extended position, a resonance circuit made up of the coil antenna element 16 and the capacitor 15 is provided in parallel to the rod antenna element 11, by which the 2-resonance characteristic can be obtained. When the rod antenna element 11 is retracted in the casing 9, the metal disc 11C and contact terminal C3 contact each other and the tap 16T of the coil antenna element 16 is connected via the antenna element 11 to the feeder 14, and consequently, the coil antenna element 16 serves as a quarterwave radiation element of one resonance characteristic. In this case, the coil part from the top end portion of the coil antenna element 16 to the tap 16T becomes shorted and draws substantially no current.

Figure 16A:
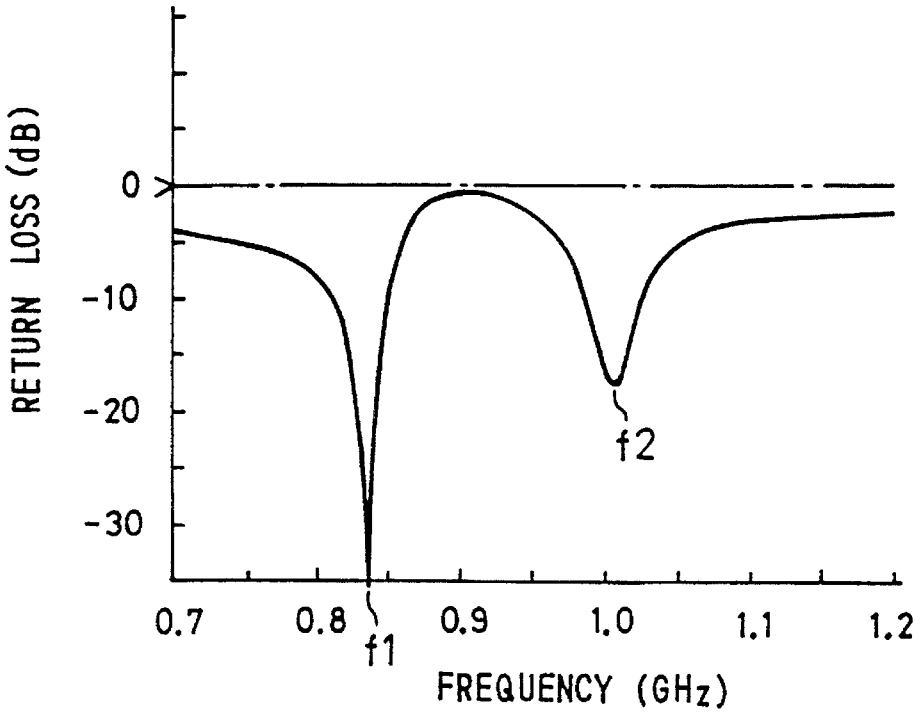
FIG. 16A is a graph showing the return-loss characteristic of the FIG. 15A embodiment with the antenna held at its projecting-out position.
Figure 16B:
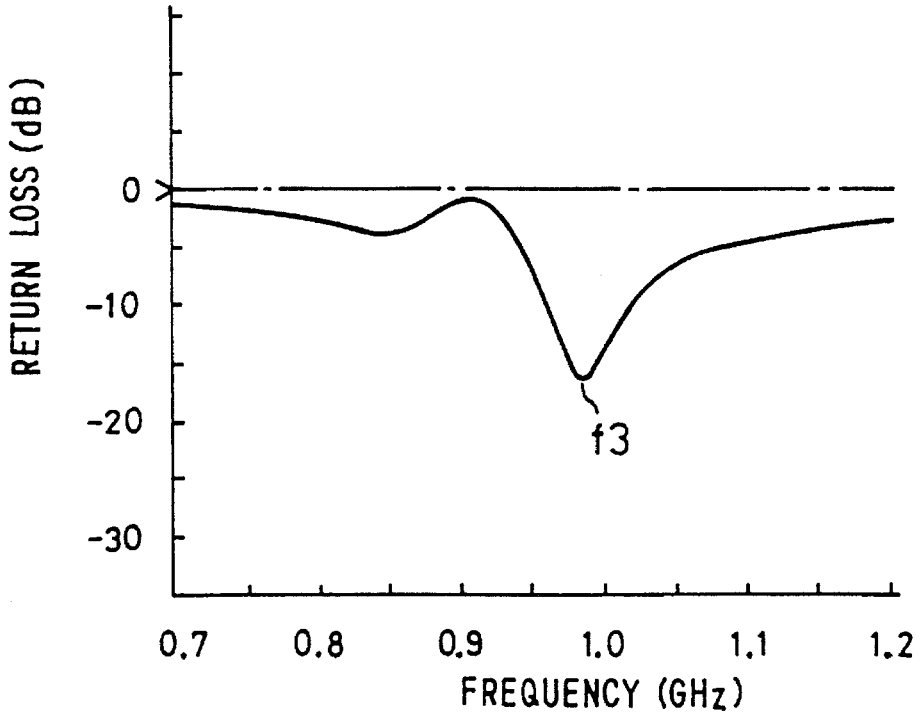
FIG. 16B is a graph showing the return-loss characteristic of the FIG. 15A embodiment with the antenna held at its retracted position.

FIG. 16A is a graph showing the return-loss characteristic measured when the rod antenna element 11 shown in FIG. 15A was at the extended position, f1 and f2 being resonance frequencies. FIG. 16B is a graph showing the return-loss characteristic measured when the rod antenna 11 was at the retracted position, f3 being a resonance frequency. The metal cylinder 12 was 8 cm long and 1 cm in diameter; the maximum length of the rod antenna element 11 was 15 cm; the coil antenna element 16 was 1 cm in diameter and its number of turns was 3; the capacitance of the capacitor 15 was about 1 pF; and the antenna equipment was mounted on a casing of a volume about 200 cc. As shown in FIG. 16A, a 2-resonance characteristic wherein the antenna resonates at f1=835 MHz and f2=1005 MHz was obtained. As shown in FIG. 16B, when the rod antenna 11 was at the retracted position, a characteristic wherein the antenna resonates at f3=990 MHz was obtained by connecting the tap 16T to the portion of the coil antenna element 16 where the number of turns was about 2.5. Thus, by selecting the number of turns of the coil antenna element 16, the capacitance value of the capacitor 15 and the position of connection of the tap 16T, it is possible to obtain the 2-resonance characteristic when the rod antenna element 11 is at the extended position and a single resonance characteristic when the rod antenna 11 is at the retracted position.

Figure 17A:
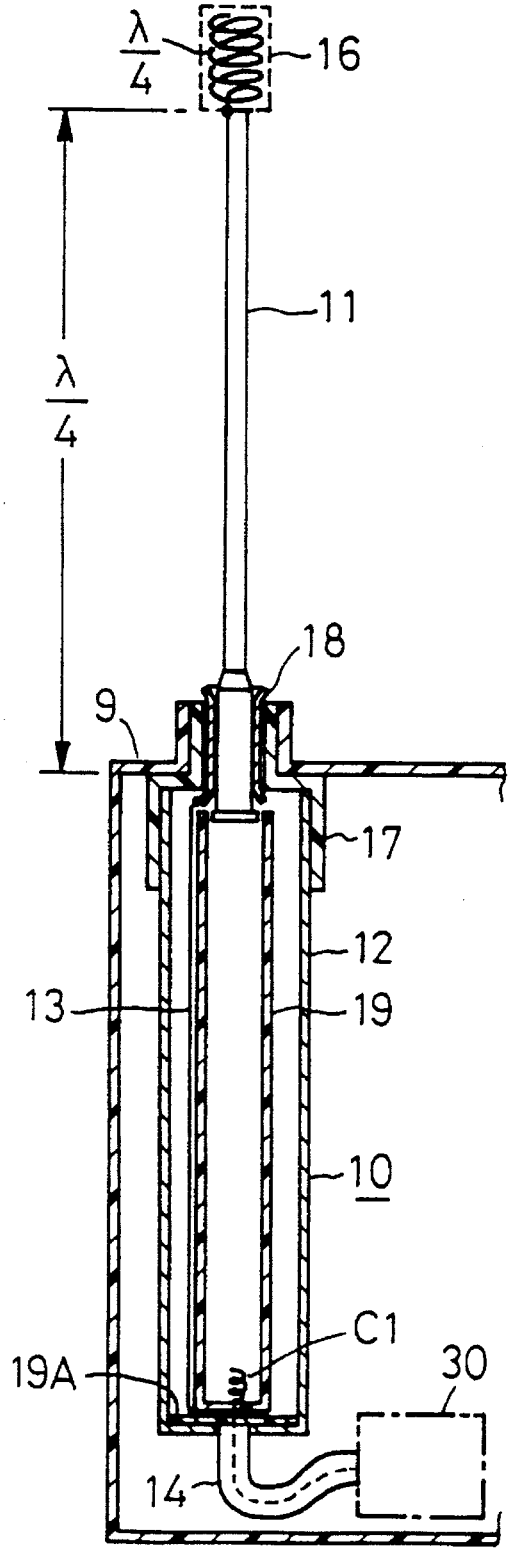
FIG. 17A is a longitudinal sectional view illustrating another embodiment of the present invention in which a quarterwave coil antenna element is connected to the tip of a quarterwave rod antenna element to form a half-way antenna.
Figure 17B:
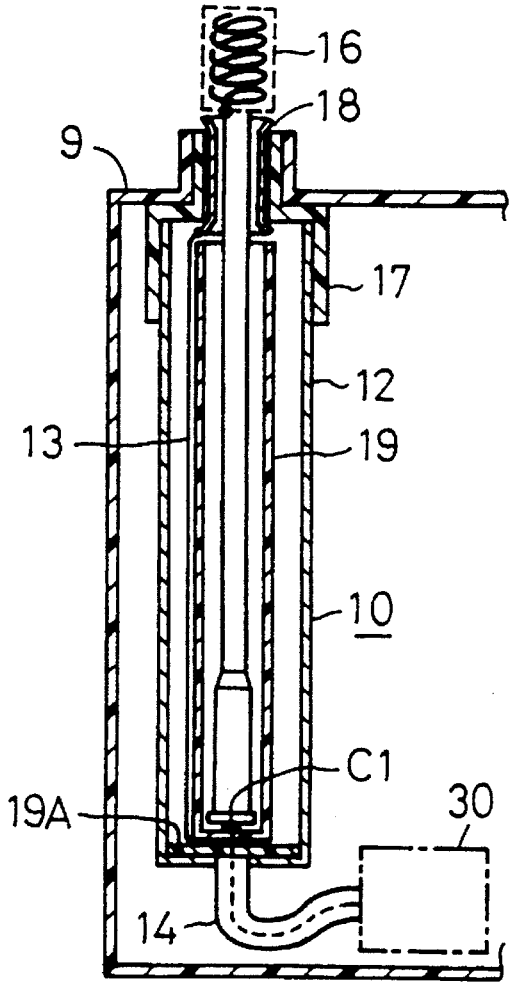
FIG. 17B is a longitudinal sectional view showing the antenna equipment of FIG. 17A with the antenna held at its retracted position.

FIG. 17A is a sectional view illustrating a fourth embodiment according to the third aspect of the invention, with the rod antenna element 11 held at the extended position, and FIG. 17B is a sectional view showing the state in which the rod antenna 11 is retracted.

In this embodiment, as in the embodiments of FIGS. 12, 14 and 15, when the rod antenna 11 is at the extended position, the coaxial impedance converter 10 is formed by the metal cylinder 12 of a length substantially equal to the half-wave length and the fine wire 13 connected between the rod antenna element 11 and the feeder 14, and when the rod antenna 11 is at the retracted position, the coaxial line 10 formed by the rod antenna element 11 and the metal cylinder 12 serves as a transmission line of about the same low impedance as that of the feeder 14. This embodiment differs from the embodiments of FIGS. 12, 14 and 15 in that the length of the rod antenna element 11 is substantially equal to the quarter-wavelength and the coil antenna element 16 is connected to the tip of the rod antenna element 11 instead of being provided immediately above the metal cylinder 12. When the rod antenna element 11 is at the extended position, the coil antenna element 16 operates as a half-wave antenna in cooperation with the rod antenna element 11, whereas when the rod antenna 11 is at the retracted position in the metal cylinder 12, the coil antenna element 16 is positioned just above the metal cylinder 12 and operates as a quarter-wave antenna.

FIGS. 18A and 18B are longitudinal sectional views illustrating a fifth embodiment of the antenna equipment according to the third aspect of the present invention. This embodiment is common to the FIG. 17 embodiment in the provision of the same coaxial impedance converter but differs therefrom in that the rod antenna 11 is composed of first and second rods $\mathbf{11}_1$ and $\mathbf{11}_2$ and has a length equal to the half-wavelength when it is extended and the quarter-wave coil antenna element 16 is mounted on the tip of the first rod $\mathbf{11}_1$ but electrically isolated therefrom. When the rod antenna element 11 is retracted in the metal cylinder 12, the contact terminal C3 at the lower end of the coil antenna element 16 contacts the contact metal member 18, and hence is connected to the low-impedance coaxial line using the second rod $\mathbf{11}_2$ as the inner conductor.

With the above antenna structure, when the rod antenna element 11 is at the extended position, only the rod antenna element 11 operates as a half-wave antenna, whereas when the rod antenna element 11 is at the retracted position, only the coil antenna element 16 operates as a quarter-wave antenna.

Figure 19A:
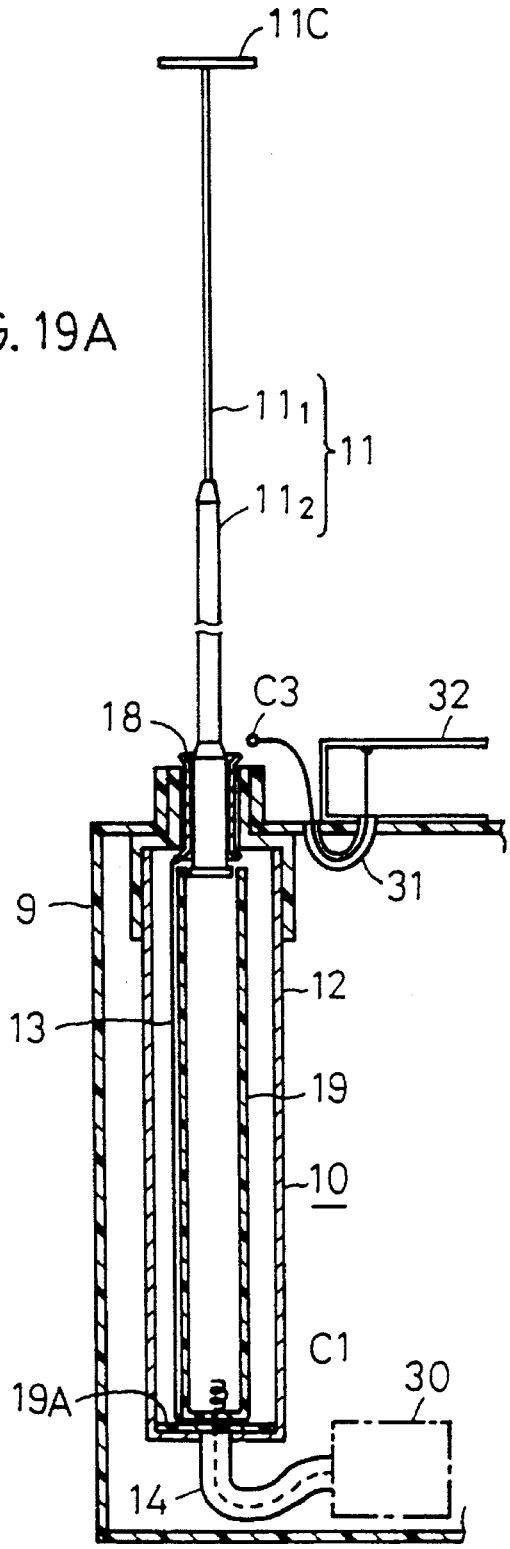
FIG. 19A is a longitudinal sectional view illustrating a modified form of the FIG. 18A embodiment in which an inverted F antenna is connected to the coaxial-type impedance converter when the antenna is held at its retracted position.
Figure 19B:
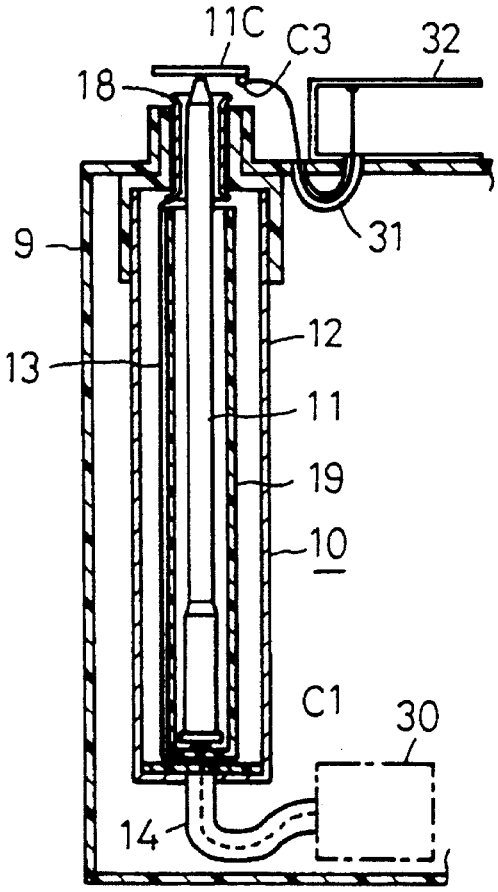
FIG. 19B is a longitudinal sectional view showing the antenna equipment of FIG. 19A with the antenna held at its retracted position.

FIGS. 19A and 19B are longitudinal sectional views of a sixth embodiment which is a modified form of the FIG. 18 embodiment according to the third aspect of the invention. In this embodiment, the coil antenna element 16 is replaced by an inverted F antenna element 32 mounted on the casing 9 and connected via a feeder 31 to the elastic contact terminal C3 provided near the contact metal member 18. When the rod antenna element 11 is at the retracted position, the metal disc 11C mounted on the tip of its first rod $\mathbf{11}_1$ contacts the contact terminal C3, connecting the inverted F antenna element 32 to the retracted rod antenna element 11 which forms the inner conductor of the low impedance coaxial line.

Figure 20A:
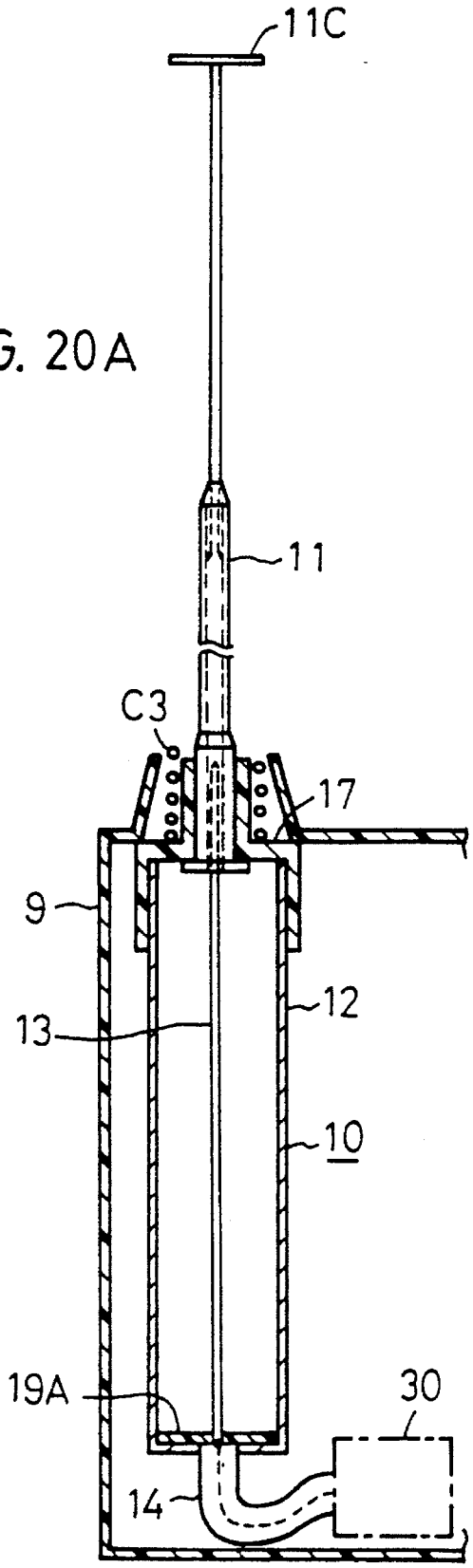
FIG. 20A is a longitudinal sectional view illustrating another embodiment of the present invention in which the inner conductor of the coaxial type impedance converter is used as an antenna retracting guide.
Figure 20B:
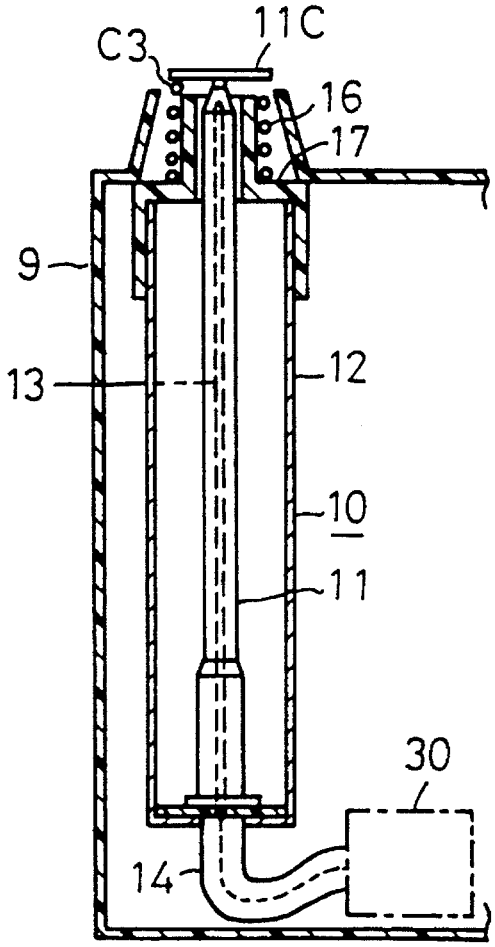
FIG. 20B is a longitudinal sectional view showing the antenna equipment of FIG. 20A with the antenna held at its retracted position.

The above-described embodiments of FIGS. 12, 14, 15, 17, 18 and 19 employ the insulating guide tube 19 for guiding the rod antenna element 11 to the retracted position, and hence has a defect that the fine wire 13 is inevitably disposed off the center axis of the metal cylinder 12. In these embodiments, however, as shown in FIGS. 20A and 20B, the insulating guide tube 19 need not always be provided and the metal fine wire 13 fixed at the lower end to the insulating support plate 19A may be disposed, also as a guide, along the center axis of the metal cylinder 12. The fine wire 13 is an elastic wire, and when the rod antenna element 11 formed by a tubular member of metal is at the extended position, the top end portion of the wire 13 still remains in the tubular body pipe of the antenna element 16 and makes sliding contact therewith.

In the FIG. 20 embodiment, the cylindrical insulating holder 17 has a large-diameter portion whose inner diameter is nearly equal to the outer diameter of the metal cylinder 12 and a small-diameter portion which projects upwardly from the larger-diameter portion and whose outer diameter is smaller than that of the metal cylinder 12, and the large-diameter portion is fitted in the top end portion of the metal cylinder 12 coaxially therewith. The coil antenna element 16 is disposed around the small-diameter portion of the holder 17 and the upper end portion of the antenna element 16 projects upwardly above the top of the holder 17. When the rod antenna element 11 is retracted in the metal cylinder 12, the metal disc 11C and the contact terminal C3 at the tip of the coil antenna element 16 make elastic contact with each other.

When the structure of this embodiment, in which the fine wire 13 is inserted in the tubular body of the rod antenna element 11 to serve as a guide, is applied to the above-described embodiments which have the rod antenna element 11 composed of the first and second rods $\mathbf{11}_1$ and $\mathbf{11}_2$, the first rod $\mathbf{11}_1$ is formed by a tubular member of metal to permit the insertion thereinto of the fine wire 13 when the rod antenna element 11 is retracted into the metal cylinder 12. This structure is applicable as well to the embodiments described later with reference to FIGS. 22 and 28.

Next, a description will be given of embodiments according to the fourth aspect of the invention which apply the antenna equipments of the above-described embodiments to a diversity antenna device.

Figure 21:
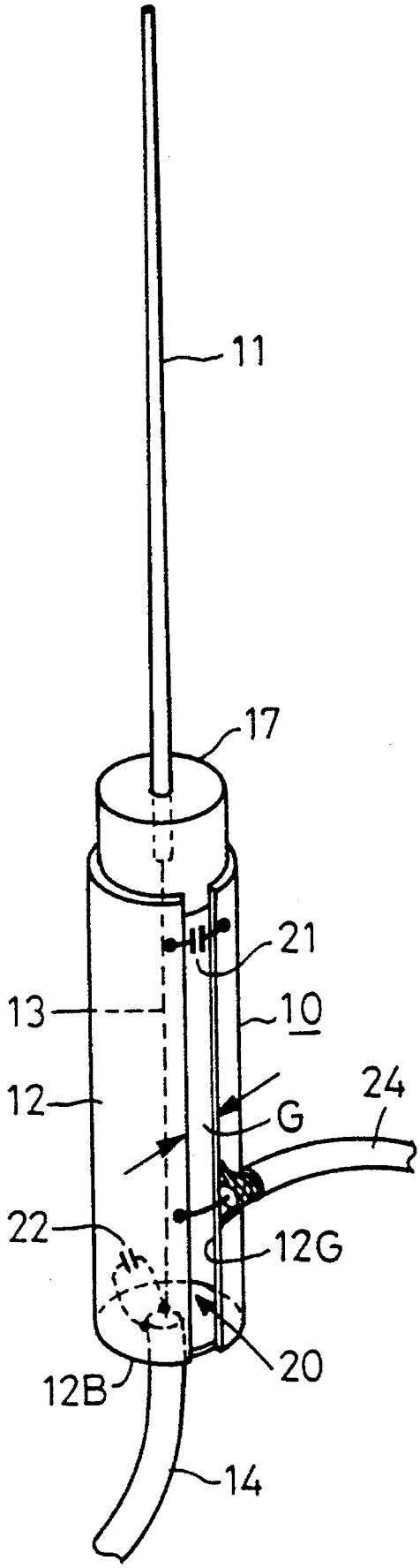
FIG. 21 is a perspective view illustrating still another embodiment of the present invention which has a slot antenna formed in the coaxial type impedance converter.

FIG. 21 illustrates a first embodiment according to the fourth aspect of the invention. At one end (the lower end in FIG. 21) of the rod antenna element 11, there is provided the coaxial impedance converter 10 substantially coaxially with the rod antenna element 11. The fine wire 13 forming the inner conductor of the coaxial impedance converter 10 is connected to the rod antenna element 11 and one end of the feeder 14 is connected to the other end of the coaxial impedance converter 10. The feeder 14 is a coaxial cable which has its core conductor connected to the inner conductor 13 and its outer conductor connected to the metal cylinder 12 which forms the outer conductor of the coaxial impedance converter 10. The end face of the coaxial impedance converter 10 at the side of the feeder 14 is closed by a metal end plate 12B. The feeder 14 is forced into a centrally disposed aperture of the end plate 12B to press the peripheral portion of the outer conductor of the feeder 14 into contact with the marginal edge of the aperture.

The metal cylinder 12 has a slit 12G extending lengthwise thereof to form a slot antenna 20, to which one end of the feeder 14 is connected. When the feeder 14 is a coaxial cable, its center conductor and outer conductor are connected at one end to opposed edges of the slit 12G at a midpoint in the slot antenna 20. Moreover, in this embodiment, a capacitor 21 is connected between both edges of the slit 12G so that the slot antenna 20 resonates at a desired wavelength. The length of the rod antenna element 11 may preferably be about one-half the wavelength used. It is preferable that the width of the slit 12G of the slot antenna 20 be smaller than one-tenth the wave-length used, as is the case with an ordinary slot antenna. From the viewpoint of matching the impedances of the rod antenna element 11 and the feeder 14, the length of the coaxial impedance converter 10 is determined and this length is equal to the length of the slot antenna 20.

Since the slot antenna 20 is formed by forming the slit 12G in the metal cylinder 12 in parallel to the axis of the coaxial impedance converter 20, the space occupied by the coaxial impedance converter 10 is partly shared by the slot antenna 20, but the impedance converter 10 and the slot antenna 20 operate independently of each other because they operate on currents perpendicularly intersecting with each other on the outer conductor. The operation of the coaxial impedance converter 10 is the same as that described previously with reference to the FIG. 8 embodiment, for instance.

The characteristic impedance Zo of the coaxial impedance converter 10 is set to a value close to a mean multiplied value $(ZaZb)^{1/2}$of the impedance Za (50 ohms) and the impedance Zb (hundreds of ohms) of the feeder 14 at the time of feeding the antenna element 11 from the lower end thereof, and the length of the coaxial impedance converter 10 is set to about $\lambda/4$. To set the characteristic impedance Zo of the coaxial impedance converter 10 to around 200 ohms, for example, the diameter ratio between the inner and outer diameters of the metal cylinder 12 and the fine wire 13 needs only to be about 6. For instance, when the diameter of the inner conductor 13 is 1 mm, the diameter of the outer conductor 12 is 6 mm. With this structure, the impedance converter 10 performs the impedance conversion, matching the impedances of the feeder 14 and the rod antenna element 11. In some cases, however, imaginary parts of the impedances may not completely be matched. Such incomplete impedance matching could be avoided by connecting a capacitor 22 in parallel to the connection point between the feeder 14 and the coaxial impedance converter 10 and properly adjusting the capacitance of the capacitor 22. This matching scheme can be applied to all embodiments of the present invention.

On the other hand, the width G of the slit 12G may be arbitrary because its length is fixed, and the capacitor 21 is connected across the gap of the slit 12G so that it may efficiently operate as an antenna or may resonate at the wavelength used.

Thus, in this antenna equipment, the slit 12G cut in the metal cylinder 12 in its axial direction functions as the slot antenna 20 for taking out the antenna current flowing in the metal cylinder 12 in its circumferential direction; hence, the metal cylinder 12 forming the impedance converter 10 for the rod antenna 11 and the slot antenna 20 share the same space. In the operation as the coaxial impedance converter 10 the antenna current flows in the axial direction of the outer conductor (the metal cylinder) 12, whereas in the operation as the slot antenna 20 the antenna current flows in the circumferential direction of the outer conductor 12; accordingly, the two operations are independent of each other. Furthermore, as in the above-described embodiments, the coaxial impedance converter 10 is wide-band by nature and is low-loss because it is not a matching circuit using a concentrated constant. Besides, this antenna equipment is hardly affected by the antenna casing since the coaxial structure produces the effect of the stub. That is, the impedance at the side of the impedance converter 10, viewed from the junction point of the impedance converter 10 and the rod antenna element 11 is so high that the current flowing through this portion is small and the current to the outside is also appreciably reduced. Thus, the antenna structure of this embodiment achieves high gains and a wide-band characteristic, lessens the influence of the antenna casing and permits the implementation of a very small diversity antenna equipment.

Figure 22:
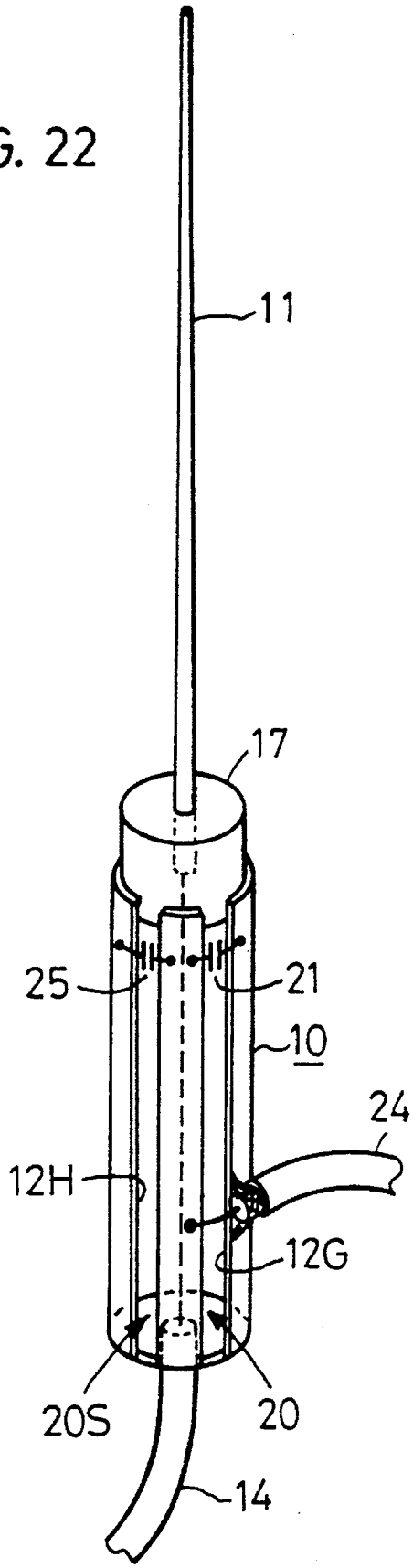
FIG. 22 is a perspective view illustrating a modified form of the FIG. 21 embodiment which has two slot antennas formed in the coaxial type impedance converter.

FIG. 22 illustrates a second embodiment of the antenna equipment according to the fourth aspect of the present invention, in which the parts corresponding to those in FIG. 21 are identified by the same reference numerals. In this embodiment, another slit 12H is formed in the outer conductor 12 near the slit 12G in parallel thereto, forming a second slot antenna 20S. The second slot antenna 20S also has a capacitor 25 connected across its gap.

In this embodiment, the two slits 12G and 12H are both formed in the axial direction of the outer conductor 12, and hence operate without disturbing a coaxial mode current flowing in the axial direction of the outer conductor 12. Since the two slot antennas 20 and 20S can thus be formed, it is possible to obtain a wide-band characteristic by using one of the slot antennas as a parasitic element and selecting the resonance frequencies of the two slot antennas relatively close to each other or to obtain a 2-band characteristic (a double resonance characteristic) by separating the resonance frequencies of the two slot antennas relatively far apart. Other advantages obtainable with this embodiment are exactly the same as those with the FIG. 21 embodiment. While it is desirable that the spacing of the slits 12G and 12H be, for example, 0.1 $\lambda$ or less, its preferable value is determined in accordance with the resonance frequencies of the slot antennas 20 and 20S and the thickness of the outer conductor 12.

Figure 23:
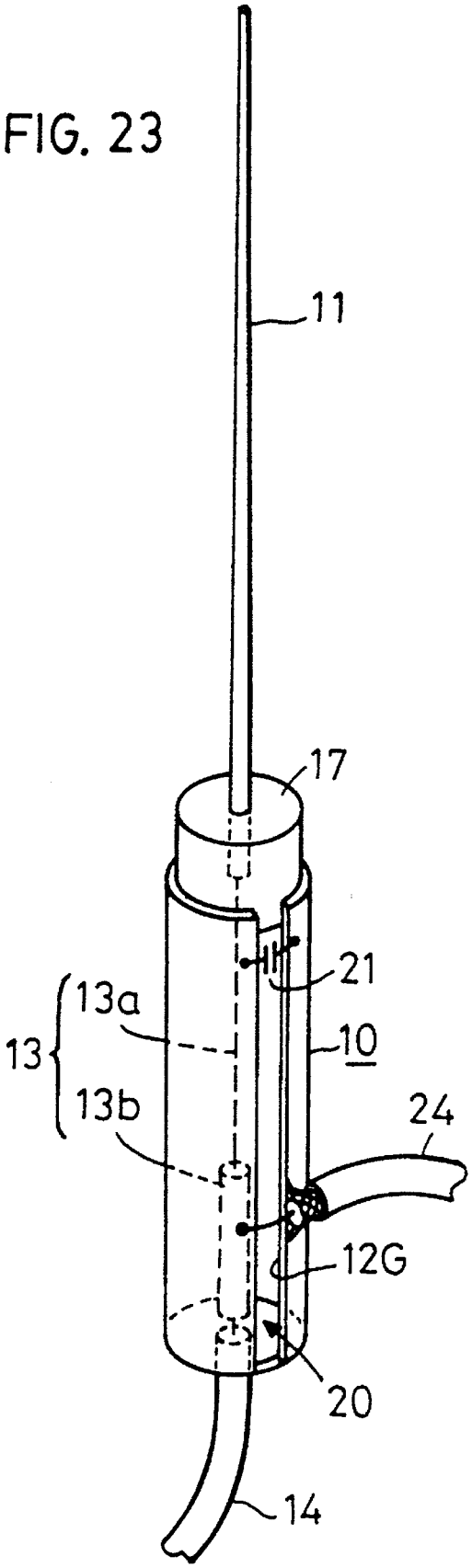
FIG. 23 is a perspective view illustrating another modification of the FIG. 21 embodiment in which the inner conductor of the coaxial type impedance converter is changed at a predetermined midpoint therein.
Figure 24A:
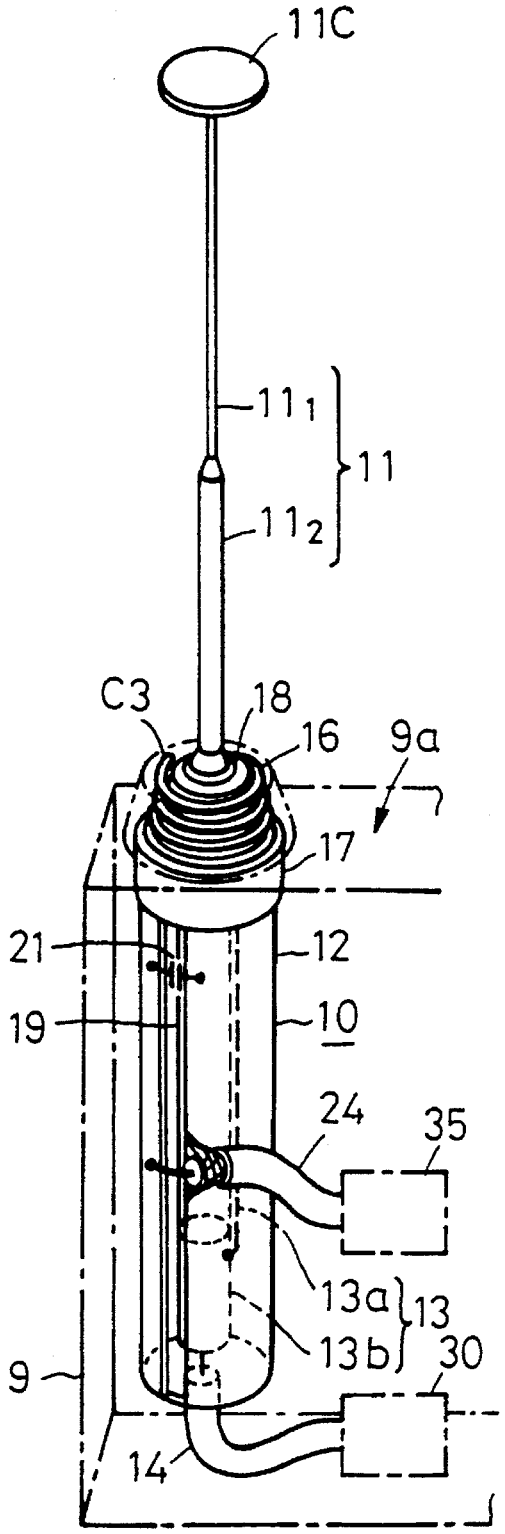
FIG. 24A is a perspective view illustrating an example of a diversity antenna embodying the present invention, with the antenna held at its extended-out position.
Figure 24B:
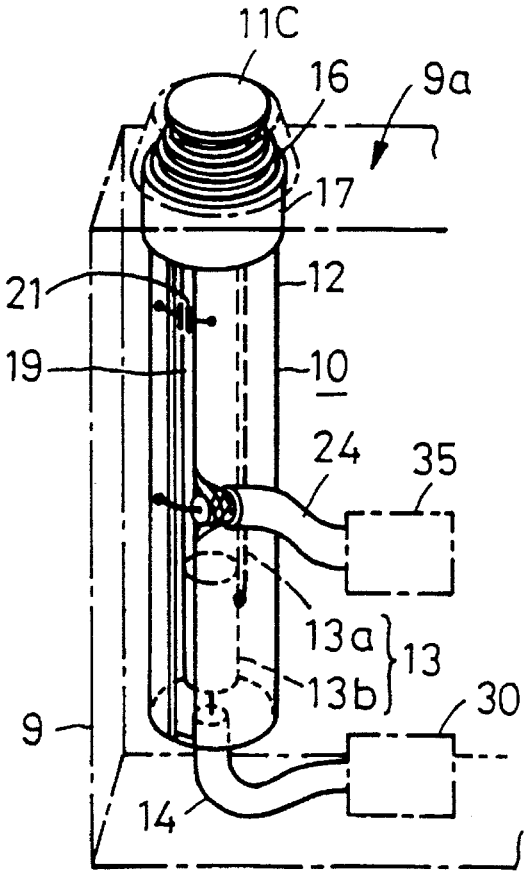
FIG. 24B is a perspective view showing the FIG. 24A example, with the antenna held at its retracted position.
Figure 24C:
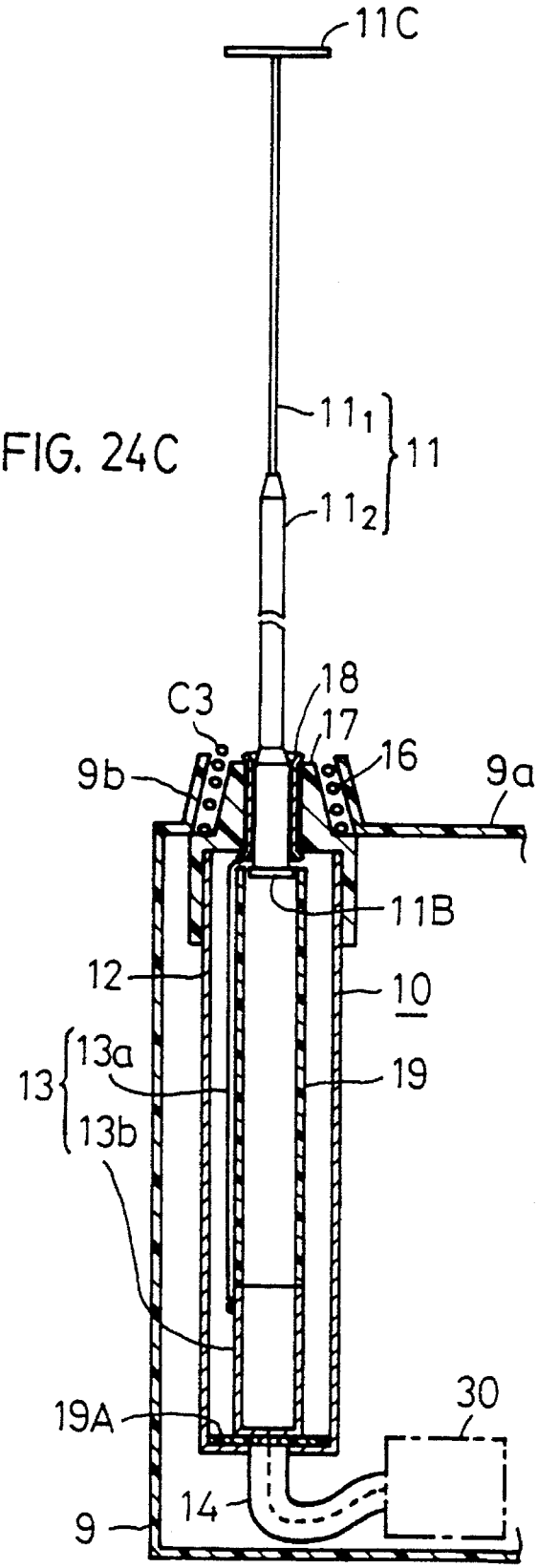
FIG. 24C is a longitudinal sectional view of the FIG. 24A example.
Figure 24D:
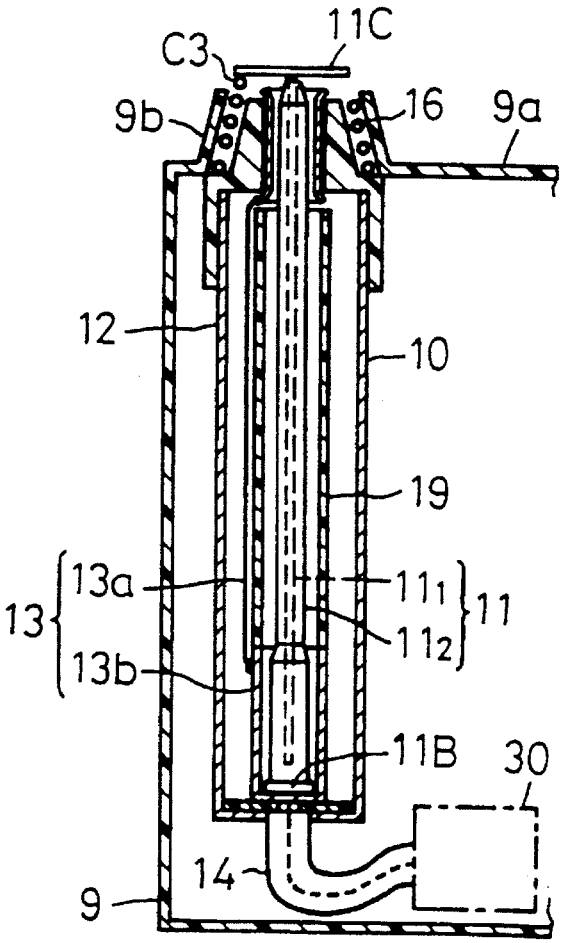
FIG. 24D is a longitudinal sectional view showing the diversity antenna with the antenna retracted.

FIG. 23 illustrates a third embodiment of the antenna equipment according to the fourth aspect of the present invention. In this embodiment, the fine wire 13 used as the inner conductor of the coaxial impedance converter 10 has two different diameters; that is, the part **13*b* of the inner conductor 13 near the feeder 14 is larger in diameter than the part 13*a* opposite therefrom. This structure implements a two-stage matching circuit, since the small- and large-diameter portions 13*a* and 13*b* of the inner conductor 13 provide different characteristic impedances for the coaxial impedance converter 10. By selecting the large-diameter portion 13*b* of the inner conductor 13 in correspondence to a 50-ohm characteristic impedance, only the small-diameter portion 13*a* of the inner conductor 13 virtually operates as a matching circuit; hence, a coaxial matching circuit of a desired length can be formed regardless of the apparent length of the outer diameter 12. Other advantages obtainable with this embodiment are exactly the same as those with the FIG. 21** embodiment.

FIGS. 21A through 24D illustrate a fourth embodiment of the antenna equipment according to the fourth aspect of the present invention, in which the slot antenna 20 is provided in the FIG. 14 embodiment to form a small diversity antenna for use with portable radios which achieves high gains even when the rod antenna element 11 is at the retracted position. The casing 9 is made of a dielectric material such as a synthetic resin. On the outside of the upper small-diameter portion of the insulating holder 17 mounted on the top of the metal cylinder 12, there is disposed the coil antenna element 16 virtually coaxially with the rod antenna element 11. When the rod antenna element 11 is at the extended position, the coil antenna element 16 is isolated from the rod antenna element 11 and the impedance converter 10.

A tubular sliding contact member 18 made of metal is fitted in the tubular insulating holder 17, with the axis of the former substantially aligned with the axis of the outer conductor 12, and the rod antenna element 11 is slidably received in the tubular sliding contact member 18. The rod antenna element 11 has at its lower end a flange 11B to prevent it from coming off the tubular sliding contact member 18. The small-diameter portion **13*a* of the inner conductor 13 is connected to the tubular sliding contact member 18 and is electrically connected therethrough to the rod antenna element 11. The length of the coil antenna element 16 over the entire coil is selected nearly equal to the quarter-wave length. The rod antenna element 11** has a length substantially equal to the half-wave length when it is extended.

The coil antenna element 16 and the metal disc 11C need only to be electrically connected, and hence need not always be mechanically contacted. Therefore, power may be supplied to the coil antenna element 16 through utilization of the proximity capacitance produced by the coil antenna element 16 and the metal disc 11C being slightly spaced apart.

In this state of contact, the inner end of the rod antenna element 11 stays in the large-diameter portion **13*b* of the inner conductor 13 and the rod antenna element 11 is electrically connected via the large-diameter portion 13*b* to the feeder 14, with the result that the coil antenna element 16 is excited via the rod antenna element 11. In this embodiment, the flange 11B attached to the lower end of the rod antenna element 11 butts against the blocking end plate of the large-diameter portion 13*b* to limit further downward movement of the rod antenna element 11**.

In this example, the rod antenna element 11 is telescopic and its second rod $\mathbf{11}_2$ near the impedance converter 10 is tubular and the first rod $\mathbf{11}_1$ is smaller in diameter than the second rod $\mathbf{11}_2$ so that the former can be slid into and out of the latter.

In the illustrated embodiment, the coil antenna element 16 is disposed in a truncated conical portion **9*b* protruded from the top panel 9*a* of the casing 9. The coaxial impedance converter 10 is fixed to the casing 9 in the inside thereof to secure thereto the antenna equipment. The feeders 14 and 24 are connected to receiving portions 30 and 35 in the casing 9** and the received outputs are diversity-combined in a combining part, though not shown.

Although in the above-described embodiments the length of the rod antenna element 11 and the length of the outer conductor 12 have been described to be about $\lambda/2$ and $\lambda/4$, respectively, the length of the rod antenna element 11 may be arbitrary, in which case the length and characteristic impedance of the coaxial impedance converter 10 need only to be properly chosen in accordance with the length of the rod antenna element 11. For example, it is possible to select the length of the rod antenna element 11 to be 0.7 $\lambda$ and direct it upward about 30 degrees at maximum in the vertical plane containing the rod antenna element 11, or to select the length of the rod antenna element 11 to be 0.3 $\lambda$ and direct it downward about 30 degrees at maximum. Incidentally, the direction of the maximum directivity of the rod antenna element 11 having a length of 0.5 $\lambda$ in the vertical plane is the horizontal direction (the lateral direction).

Figure 25A:
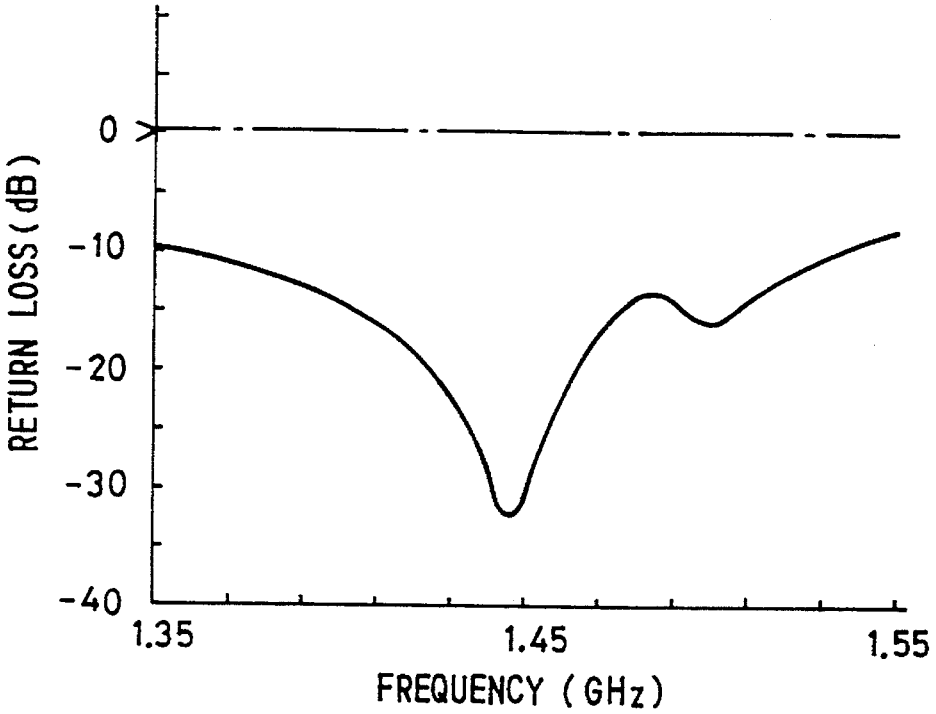
FIG. 25A is a graph showing the impedance characteristic of the rod antenna element in the FIG. 24A example when the antenna is held at its extended-out position.
Figure 25B:
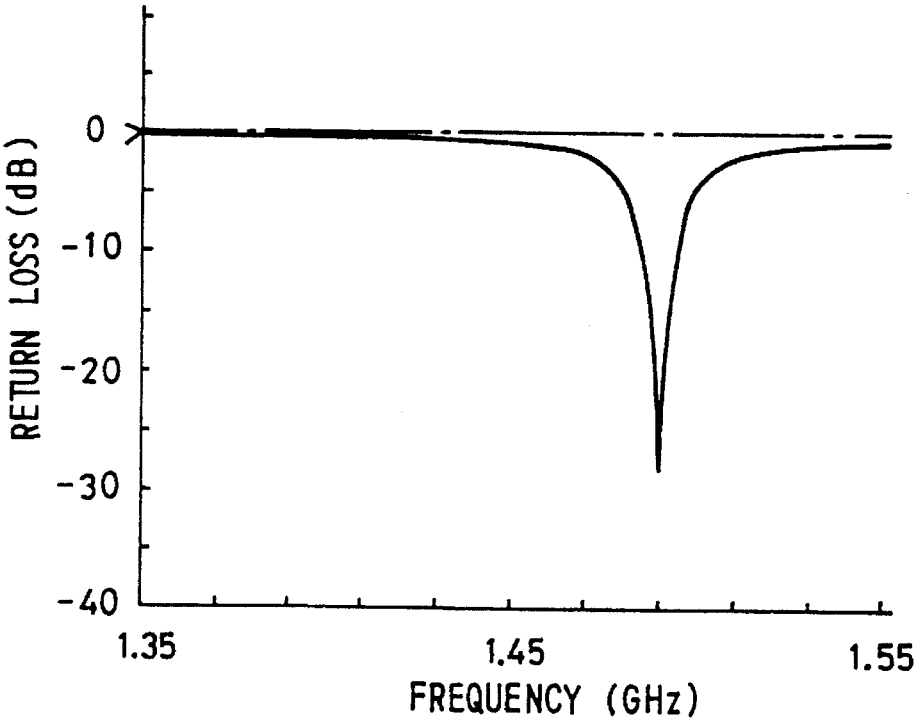
FIG. 25B is a graph showing the impedance characteristic of the slot antenna element when the antenna is held at its extended-out position.
Figure 26A:
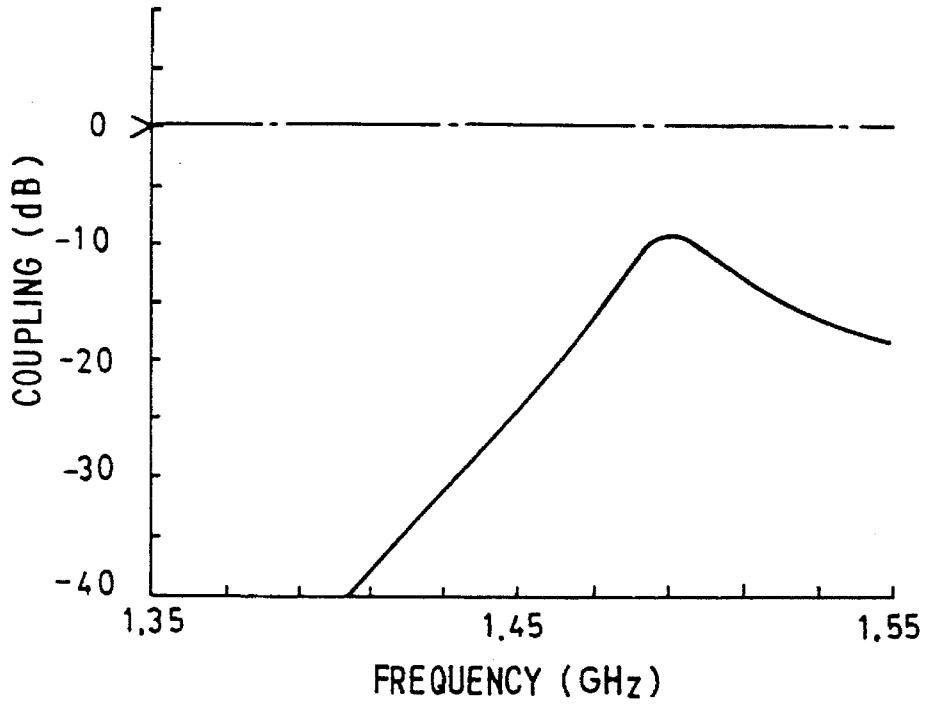
FIG. 26A is a graph showing the coupling characteristic of the rod and slot antenna elements when the antenna was held at its extended-out position.
Figure 26B:
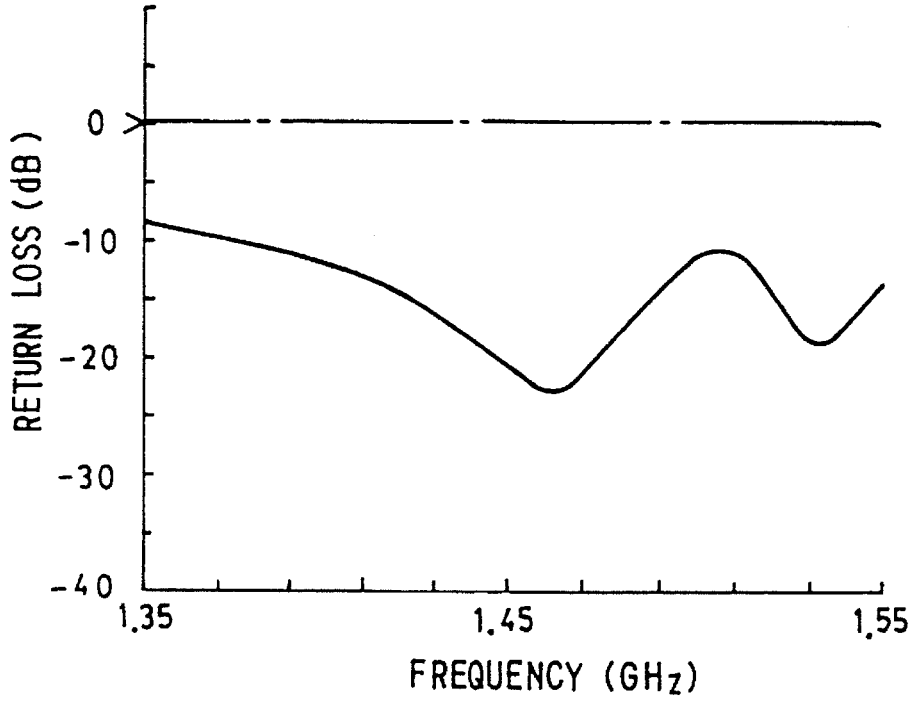
FIG. 26B is a graph showing the return-loss characteristic of the rod antenna element when the antenna is held at its retracted position.

In FIGS. 25 through 27 there are shown the results of experiments conducted with the antenna equipment of the FIG. 24 embodiment. The values shown in FIGS. 25 through 27 are impedance characteristics measured in the case where the outer conductor 12 was 5 cm long and 1 cm in diameter, the rod antenna element 11 was 10 cm long, the coil antenna element 16 was 1 cm in diameter and had a number of turns of 2.5, the slit 12G was 5 cm long and 3 mm wide, the capacitor 21 had a capacitance of about 1 pF and the coaxial impedance converter 10 was disposed in a dielectric casing 9 of a volume about 200 cc. FIG. 25A shows the return-loss characteristic of the rod antenna element 11 when it was extended, FIG. 25B the return-loss characteristic of the slot antenna 20 when the rod antenna element 11 was at the extended position, FIG. 26B the coupling characteristic of the rod antenna element 11 and the slot antenna 20 when the former was at the extended position, and FIG. 26B the characteristic of the rod antenna element 11 when it was at the retracted position.

FIG. 25A and 25B show that when the rod antenna element 11 is at the extended position, it resonates with a frequency of about 1.44 GHz and the slot antenna 20 resonates with a frequency of about 1.59 GHz; their coupling is around 9 dB at maximum and when the rod antenna element 11 is retracted, it resonates with a frequency of about 1.46 GHz. That is, it was experimentally demonstrated that when the rod antenna element 11 is at the extended position, the rod antenna element 11 and the slot antenna 20 can be made to resonate independently of each other, though they share the same space, that their coupling is about 9 dB and that the rod antenna element 11 can be made to resonate with an arbitrary frequency even when it is at the retracted position.

Figure 27A:
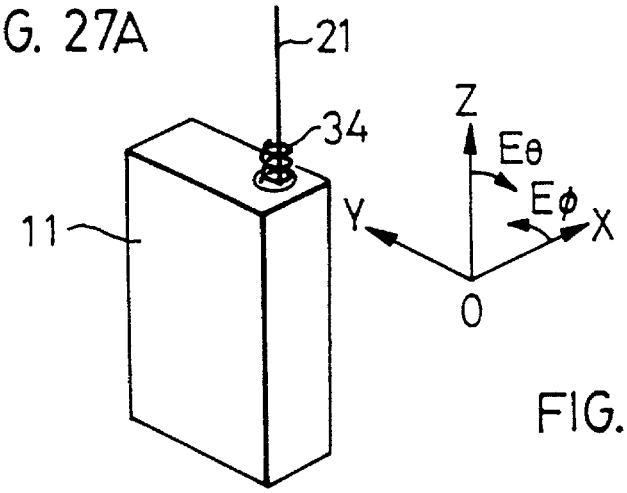
FIG. 27A is a diagram showing the relationships of the rod antenna element, the antenna housing, the measuring electric fields and the coordinates used for measuring the radiation patterns of the FIG. 24A example.
Figure 27B:
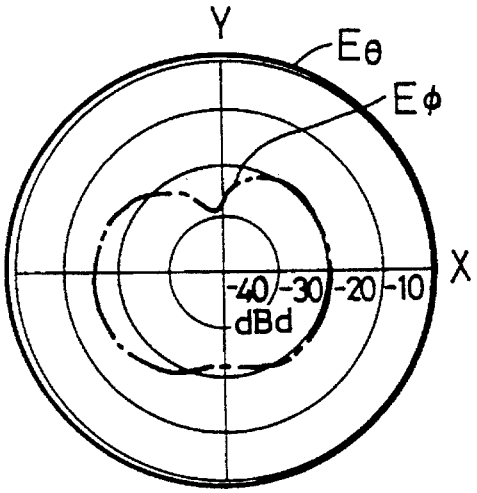
FIG. 27B is a diagram showing the radiation pattern of the rod antenna element in the horizontal plane (X-Y)

FIGS. 27B through 27E show the radiation patterns measured when the rod antenna element was held at the extended position. In FIG. 27A there are shown the relationships among the casing 9, the rod antenna element 11, the coordinate axes X, Y and Z, the electric field E $\theta$ emanating from the Z axis along a spherical surface with its center at the origin O and the electric field E $\phi$ along a circle in the X-Y plane with its center at the origin O. FIG. 27B shows the radiation pattern of the rod antenna element 11 in the horizontal plane (X-Y plane), FIG. 27C the radiation pattern of the rod antenna element 11 in the vertical plane (Y-Z plane), FIG. 27D the radiation pattern of the slot antenna 20 in the horizontal plane (X-Y plane) and FIG. 27E the radiation pattern of the slot antenna 20 in the vertical plane (X-Z plane).

Figure 27C:
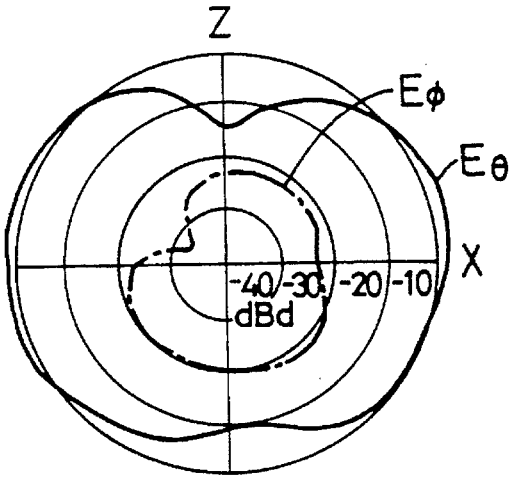
FIG. 27C is a diagram showing the radiation pattern of the rod antenna in the vertical plane (X-Z)
Figure 27D:
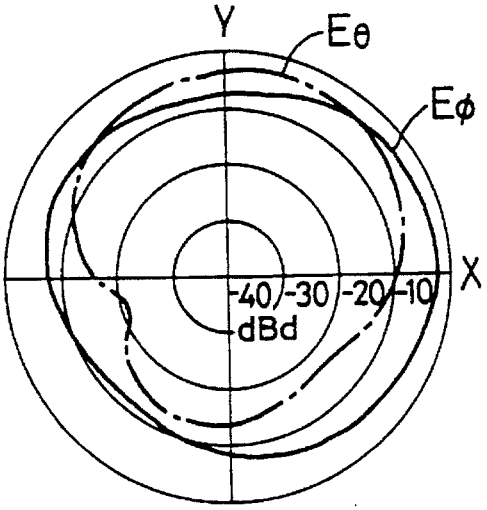
FIG. 27D is a diagram showing the radiation pattern of the slot antenna element in the horizontal plane (X-Y)
Figure 27E:
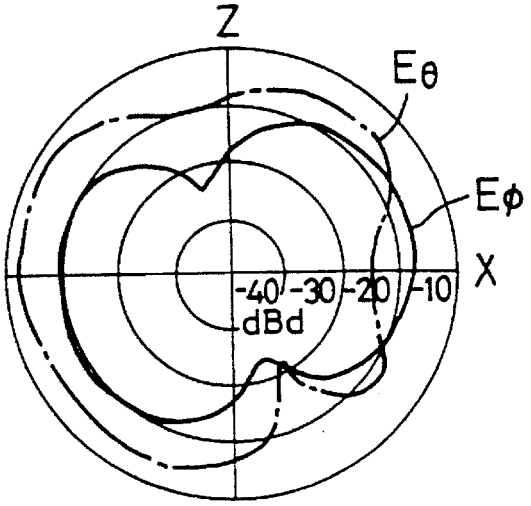
FIG. 27E is a diagram showing the radiation pattern of the slot antenna element in the vertical plane (X-Z)

As depicted in FIGS. 27B and 27C, the radiation pattern of the rod antenna element 11 in the horizontal (X-Y) plane is virtually round and the radiation pattern in the vertical plane is close to an 8-letter shaped pattern, and the radiation level is about the same as that of a half-wave dipole antenna. This reveals that the rod antenna element 11 acts as a half-wave antenna and suffers practically no loss. The slot antenna 20 has a relatively unidirectional pattern in the horizontal plane and the radiation level is lower about 3 dB than the dipole antenna.

Furthermore, the correlation function of both antennas measured outdoors was below 0.6 although they shared the same space. From the radiation patterns and the measured value of the correlation function, it is seen that the diversity effect is also satisfactory. Thus, this antenna structure permits the implementation of an antenna equipment which has high gains and a wide-band characteristic, lessens the influence of the antenna casing and achieves high gains when the rod antenna element is at the retracted position and which can be made very small as a diversity antenna.

Figure 28A:
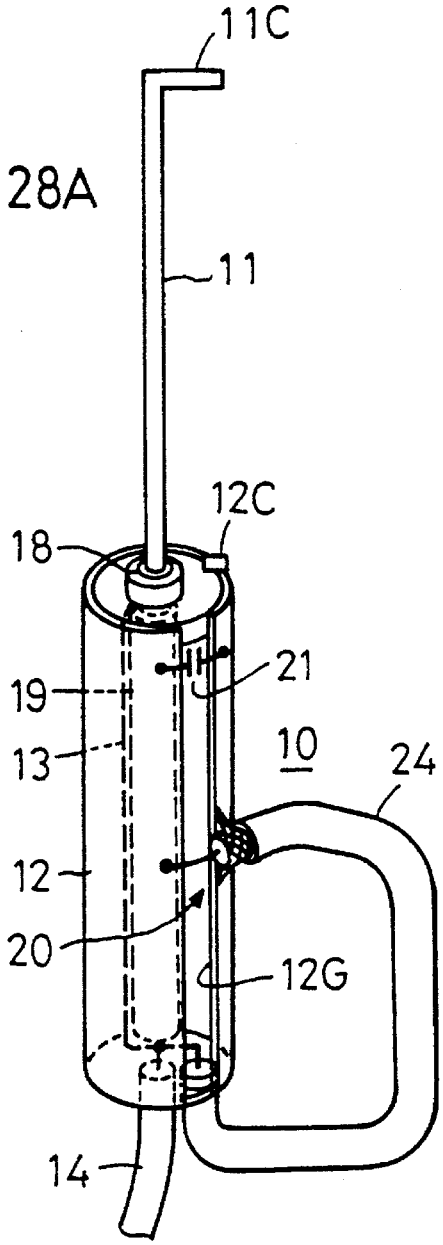
FIG. 28A is a perspective view illustrating a modified form of the FIG. 21 embodiment, with the antenna held at its extended-out position.
Figure 28B:
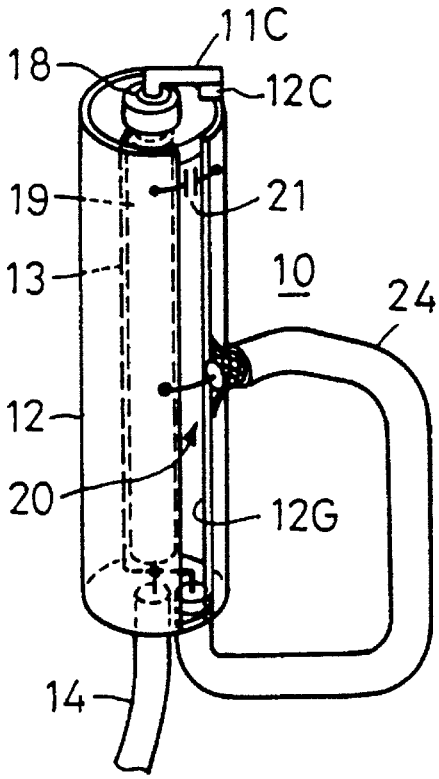
FIG. 28B is a perspective view showing the FIG. 28A example, with the antenna held at its retracted position.

FIGS. 28A and 28B illustrate a fifth embodiment of the antenna equipment according to the fourth aspect of the present invention. In this embodiment, when it is at the extended position, only the rod antenna element 11 operates as an antenna, whereas when the antenna element 11 is at the retracted position, only the slot antenna 20 operates as an antenna. As is the case with the FIG. 24 embodiment, the rod antenna element 11 is slidably received in the coaxial impedance converter 10. In this embodiment, the insulating guide tube 19 is extended almost all over the length of the outer conductor 12. Furthermore, the tubular sliding contact member 18 is also provided to slidably receive the rod antenna element 11.

In this embodiment, the other end of the feeder 24 for the slot antenna 20 is connected in parallel to the feeder 14 at the junction point of the impedance converter 10 and the feeder 14. The length of the impedance converter 10 is selected substantially equal to the quarter-wave length. Besides, a short-circuit means 11C is provided to connect the projecting end of the rod antenna element 11 to the outer conductor 12 when the rod antenna element 11 is at the retracted position. In the illustrated example, the top end portion of the rod antenna element 11 is bent substantially at right angles to form the short-circuit means 11C. To ensure good contact of the short-circuit means 11C with the outer conductor 12, a small contact piece 12C is extended from the marginal edge of the outer conductor 12 near the rod antenna element 11 toward the inner conductor 12 so that the short-circuit means 11C goes down into contact with the small contact pieces 12C when the rod antenna element 11 is retracted. To prevent the rod antenna element 11 from turning about its axis, its flange 11B (see FIGS. 24C and 24D), for example, is partly cut off and a ridge is formed on the interior surface of the guide tube 19 in its axial direction so that it slides into engagement with the notch of the flange 11B.

The capacitance of the capacitor 21 is chosen so that when the rod antenna element 11 is at the retracted position, the slot antenna 20 resonates with a desired frequency and so that the impedance at the side of the feeder 24 viewed from the connection point of the feeders 14 and 24 becomes equal to the 50-ohm characteristic impedance of the coaxial cable. When the rod antenna element 11 is at the extended position, the resonance frequency of the slot antenna 20 is low and the frequency band is narrow; therefore, the impedance at the side of the feeder 24 viewed from the connection point of the feeders 14 and 24 is made appreciably high.

Consequently, when the rod antenna element 11 is extended, the impedance of the slot antenna 20 viewed from the connection point of the feeders 14 and 24 is markedly high and only the impedance of the rod antenna element 11, converted by the coaxial impedance converter 10 to 50 ohms, is observed and the rod antenna element 11 radiates. 0n the other hand, when the rod antenna element 11 is retracted, the coaxial impedance converter 10 viewed from the connection point of the feeders 14 and 24 becomes a $\lambda/4$ short-circuit line and provides an infinite impedance, since the tip of the converter 10 is short-circuited by the short-circuit means 11C. However, since the slot antenna 20 is matched to 50 ohms, power is fed to the slot antenna 20 via the feeder 14 and the slot antenna 20 radiates.

This antenna structure can be applied to a diversity antenna by forming two slits as shown in FIG. 22 and using one of them as a slot antenna exclusively for the diversity antenna. Thus, this antenna structure permits the implementation of an antenna equipment which has high gains and a wide-band characteristic, lessens the influence of the antenna casing and achieves high gains when the rod antenna element is at the retracted position and which can be made very small as a diversity antenna.

Figure 29:
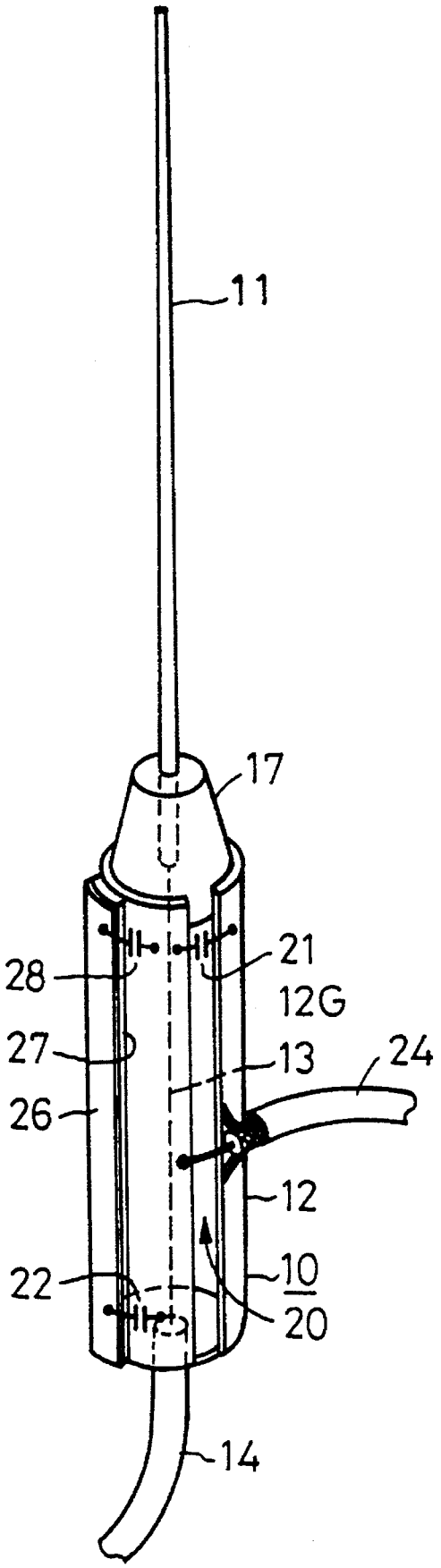
FIG. 29 is a perspective view showing another modification of the FIG. 21 embodiment.

FIG. 29 illustrates a sixth embodiment of the antenna equipment according to the fourth aspect of the present invention. A strip of metal 26, which extends near and along the slot antenna 20, is mounted on the outside of the outer conductor 12 with a dielectric spacer 27 sandwiched therebetween. A capacitor 28 for adjustment use is connected between the metal strip 26 and the outer conductor 12. The metal strip 26 may be a rod- or plate-like member. With such a structure, the metal strip 26 is disposed in very close proximity to the slot antenna 20, and hence operates as a parasitic element; by adjusting its resonance frequency with the capacitor 28 to approach the resonance frequency of the slot antenna 20, it is possible to widen the bandwidth of the slot antenna 20. In this instance, the metal strip 26 does not ever affect the operation of the rod antenna element 11 because it is disposed outside the outer conductor 12.

Figure 30A:
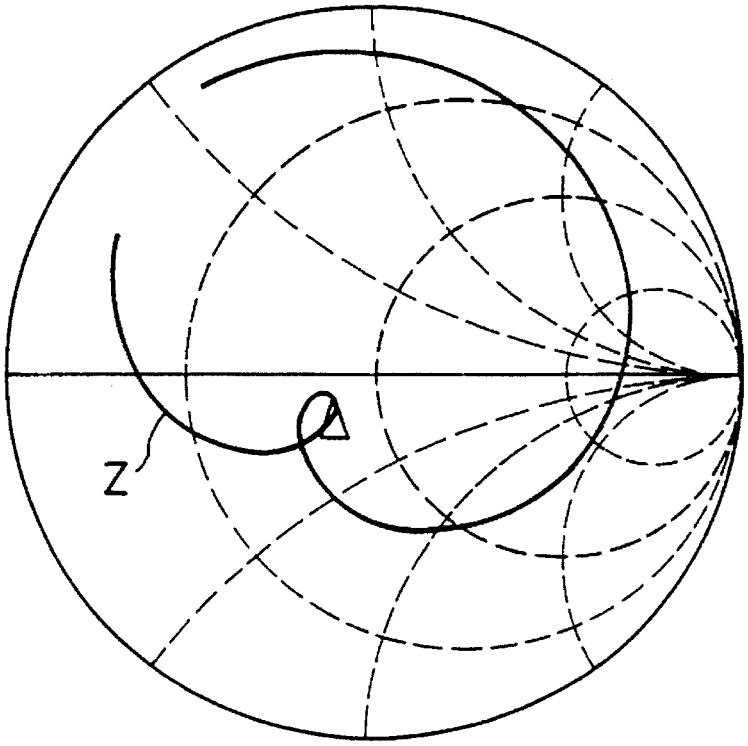
FIG. 30A is a Smith chart showing the impedance characteristic of the FIG. 29 example.
Figure 30B:
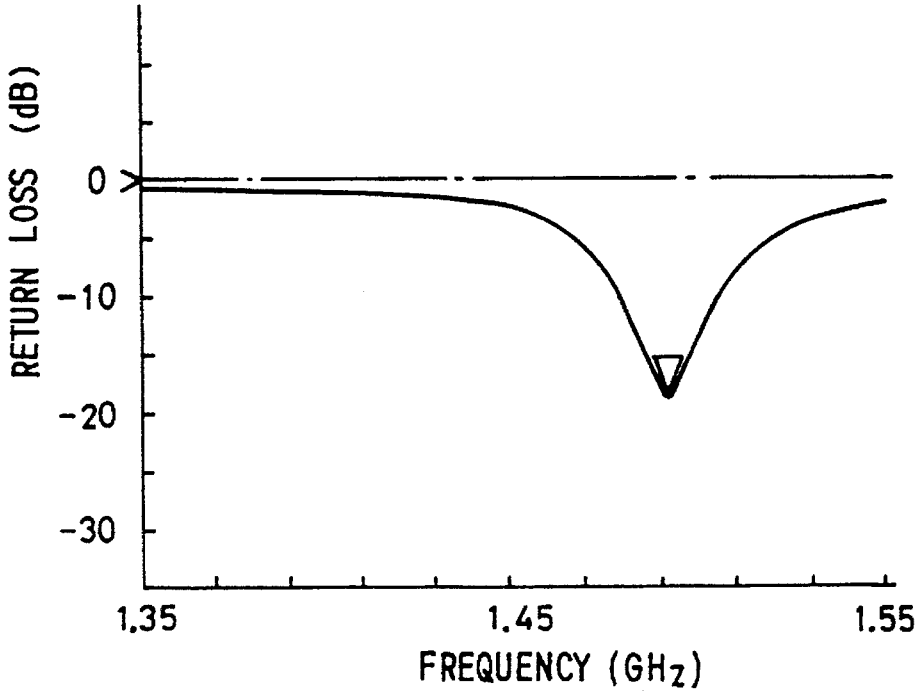
FIG. 30B is a graph showing the return-loss characteristic of the FIG. 29 example.

In FIGS. 30A and 30B there are shown measured values of the impedance characteristic in experiments conducted with the antenna equipment of this embodiment. The antenna structure was identical with that of the FIG. 24 embodiment, the flat metal strip 26 having a 5 cm length and a 2 mm width was disposed as a non-feeding element at a distance of 5 mm from the slot antenna 20, and the capacitor 28 of a capacitance about 1 pF was connected between the metal strip 26 and the outer conductor 12. FIG. 30A is a Smith chart for the impedance Z and FIG. 30B is a return-loss characteristic diagram. Comparing the return-loss characteristic in FIG. 30B with that of FIG. 25B measured in the absence of the non-feeding element, it is seen that the band becomes wider. In FIG. 30A the radiation pattern has a characteristic that lays down a trail of a small circle (a kink) near the resonance point—this is a phenomenon of an antenna having a wide-band characteristic. Thus, the antenna structure of this embodiment produces the same effects obtainable with the above-described embodiments and provides an increased band for the slot antenna 20.

In the FIG. 24 embodiment the inner conductor 13 may be made to have the same diameter over the entire length thereof. That is, the inner conductor 13 may be made thin throughout and disposed along the insulating guide tube 19; alternatively, it is possible to form the inner conductor 13 by a thick tubular member so that it can be used also as the guide tube 19. In the FIG. 28 embodiment, the inner conductor 13 may partly be formed as the large-diameter portion **13*b* as in the FIG. 22 embodiment. In the embodiments of FIGS. 23, 24 and 28, two slot antennas may be provided as shown in FIG. 22 and the parasitic element (the metal strip 26) may be disposed near each slot 20 as depicted in FIG. 29. In the embodiments of FIGS. 22 and 29, the inner conductor 13 needs not always be made to have the same diameter throughout it as shown in FIG. 23**.

As described above, according to the present invention, it is possible to offer a small antenna that has high gains and a wide-band characteristic and lessens the influence of the antenna casing, by the provision of the coaxial impedance converter and the formation therein of a slot antenna.

The present invention permits reduction of the size of the diversity antenna by the combined use of the rod antenna element and the slot antenna.

The rod antenna element can be slidably received in the coaxial impedance converter, and when it is at the extended position, only the rod antenna is allowed to operate, whereas when the rod antenna is at the retracted position, only the slot antenna is allowed to operate.

Besides, the use of the parasitic slot antenna or the non-feeding metal strip makes it possible to widen the band of the slot antenna and provide a 2-resonance characteristic.

It will be apparent that many modifications and variations may be effected without departing from the scope of the novel concepts of the present invention.

What is claimed:

1. An antenna equipment comprising:

a rod antenna element;

a metal cylinder provided at one end of said rod antenna element and axially aligned therewith, said metal cylinder having a first predetermined length in its axial direction, said first predetermined length being an integral multiple of a quarter-wavelength;

an inner conductor connected to one end of said rod antenna element and extended substantially along the center axis of said metal cylinder to form a coaxial line in combination therewith; and a feeder having a core conductor connected to said inner conductor and an outer conductor connected to said metal cylinder at one end thereof opposite from said rod antenna element;

said coaxial line forming a coaxial impedance converter and said metal cylinder having a notch formed by cutting out a part of its periphery a second predetermined length in its axial direction from its marginal edge at the side of said rod antenna element, whereby impedance of said coaxial impedance converter is matched with said rod antenna element at first and second different frequencies, respectively.

2. The antenna equipment of claim 1, wherein said notch is defined by a plane containing the center axis of said metal cylinder and a plane perpendicular to said center axis.

3. The antenna equipment of claim 1 or 2, wherein said inner conductor has a large-diameter portion at the side where it is connected to said feeder.

4. An antenna equipment comprising:

a first rod antenna element having a length that is an integral multiple of one-half wavelength to provide a first resonant frequency;

a metal cylinder provided at one end of said first rod antenna element and axially aligned therewith, said metal cylinder having a length of a quarter-wavelength;

an inner conductor connected to one end of said first rod antenna element and extended substantially along the center axis of said metal cylinder to form a coaxial line in combination therewith;

a feeder having a core conductor connected to said inner conductor and an outer conductor connected to said metal cylinder at one side thereof opposite from said first rod antenna element; and a second coil antenna element disposed around a part of said first antenna element coaxially therewith and capacitively coupled to said first antenna element via a capacitor achieving, in cooperation with said second coil antenna element, a second resonant frequency;

said coaxial line forming a coaxial impedance converter.

5.An antenna equipment comprising: a metal cylinder;

an inner conductor extended in said metal cylinder along its center axis to form a coaxial line in combination with said metal cylinder;

a first rod antenna element having a thickness larger than that of said inner conductor, said first rod antenna element projecting out from said metal cylinder and being retractable into said metal cylinder along its center axis;

sliding contact means for causing one end of said inner conductor and said first rod antenna element to make sliding contact with each other;

a feeder having a core conductor connected to said inner conductor and an outer conductor connected to said metal cylinder at one end thereof opposite from said first rod antenna element; and a second antenna element which is connected to said first rod antenna element when said first rod antenna element is retracted in said metal cylinder;

wherein when said first rod antenna element is retracted in said metal cylinder, an inner end of said first rod antenna element makes contact with said core conductor of said feeder and said first rod antenna element together with said metal cylinder constitutes a coaxial impedance converter which matches the impedance of said second antenna element and said feeder and interconnects them, and when said first antenna element is extended out from said metal cylinder, said second antenna element is disconnected from said first antenna element, said inner end of said first rod antenna is separated from said core conductor of said feeder, and said metal cylinder together with said inner conductor constitute a coaxial impedance converter which matches the impedances of said first antenna element and said feeder and interconnects them.

6. The antenna equipment of claim 5, wherein said second antenna element is a coil antenna element disposed at a top of said metal cylinder in a manner to surround a part of said first antenna element, said first rod antenna element has near a top end thereof, a contact terminal extending therefrom at right angles to its axial direction, and said contact terminal makes contact with said coil antenna element when said first rod antenna element is retracted in said metal cylinder.

7. The antenna equipment of claim 6, wherein said coil antenna element has an intermediate tap which makes contact with said contact terminal when said first rod antenna element is retracted in said metal cylinder.

8. The antenna equipment of claim 7, wherein one end of said first rod antenna element is connected via a capacitor to said sliding contact means.

9. The antenna equipment of claim 5, wherein said inner conductor has a tubular large-diameter portion for a portion thereof connected to said feeder and said first antenna element retracted in said metal cylinder is inserted into said tubular large-diameter portion of said inner conductor.

10. The antenna equipment of claim 5, wherein said second antenna element is a coil antenna element disposed at a top end of said first antenna element but electrically isolated therefrom.

11. The antenna equipment of claim 5, wherein said second antenna element is an inverted F antenna element disposed near a top end of said metal cylinder.

12. The antenna equipment of claim 5, wherein said first rod antenna element comprises first and second rods one of which is retractable into the other, said first rod antenna element has a length about one-half the wavelength used when extended and the length of said metal cylinder is about a quarter of said wavelength used.

13. An antenna equipment comprising:

a metal cylinder;

an inner conductor extended in said metal cylinder along its center axis and forming a coaxial line in combination with said metal cylinder;

a first rod antenna element having a thickness larger than that of said inner conductor, said first rod antenna element projecting out from said metal cylinder and being retractable into said metal cylinder along its center axis;

sliding contact means for bringing one end of said inner conductor and said first antenna element into sliding contact with each other;

a feeder having a core conductor connected to said inner conductor and having an outer conductor connected to said metal cylinder at one end thereof opposite from said first rod antenna element; and a second coil antenna element connected at one end to a tip of said first rod antenna element, said second coil antenna element projecting out from a top end of said metal cylinder when said first antenna element is retracted in said metal cylinder;

wherein when said first rod antenna element is retracted in said metal cylinder, an inner end of said first rod antenna element makes contact with said core conductor of said feeder and said first rod antenna element together with said metal cylinder constitute a coaxial impedance converter which matches the impedances of said second coil antenna element and said feeder and interconnects them, and when said first rod antenna element is extended out from said metal cylinder said inner end of said first antenna element is separated from said core conductor of said feeder, and said metal cylinder together with said inner conductor constitute a coaxial impedance converter which matches the impedances of said first rod antenna element and said feeder and interconnects them.

14. The antenna equipment of claim 13, wherein said first rod antenna element has a length substantially equal to a quarter of the wavelength used and said second coil antenna element has a resonance point at said wavelength used.

15. The antenna equipment of claim 5 or 13, wherein an insulating guide tube for guiding and retracting thereinto said first rod antenna element is provided in said metal cylinder, with their center axes held in alignment with each other, said inner conductor is extended over an outer peripheral surface of said insulating guide tube in its axial direction and said sliding contact means is a metal piece which is connected to one end of said inner conductor and makes sliding contact with said first rod antenna element.

16. The antenna equipment of claim 15, wherein said metal piece forming said sliding contact means is an annular member and said first rod antenna element is inserted thereinto for sliding contact therewith.

17. The antenna equipment of claim 5 or 13, wherein said first rod antenna element is a tubular element, said inner conductor is an elastic wire disposed along the center axis of said metal cylinder and having a top end portion inserted in said tubular first rod antenna element, for guiding said first rod antenna element when it is retracted into said metal cylinder, the top end portion of said elastic wire forming said sliding contact means which makes sliding contact with said first rod antenna element in its tubular body.

18. The antenna equipment of claim 4, 5, or 13, wherein said metal cylinder has a slit formed therein in its axial direction to form a slot antenna and a core conductor and an outer conductor of another feeder are connected to opposed marginal edges of said metal cylinder across said slit.

19. The antenna equipment of claim 18, wherein a capacitor for frequency adjusting use is connected between said opposed marginal edges of said metal cylinder across said slit.

20. An antenna equipment comprising:

a rod antenna element;

a metal cylinder provided at one end of said rod antenna element, with their center axes aligned with each other;

an inner conductor connected to one end of said rod antenna element and extended substantially along the center axis of said metal cylinder to form a coaxial line in combination therewith;

a first feeder having a core conductor connected to said inner conductor and an outer conductor connected to said metal cylinder at one end thereof opposite from said rod antenna element;

a slot antenna formed by a slit formed in said metal cylinder in its axial direction; and a second feeder connected at one end to said slot antenna;

wherein said coaxial line forms a coaxial impedance converter which matches the impedances of said antenna element and said first feeder and interconnects them.

21. The antenna equipment of claim 20, wherein a coil antenna element is disposed around a part of said rod antenna element coaxially therewith near the top end portion of said metal cylinder, said coil antenna element being capacitively coupled to said rod antenna element.

22. The antenna equipment of claim 20, wherein said rod antenna element is slidably received in said metal cylinder, and which further comprises:

a coil antenna element disposed around a part of said rod antenna coaxially therewith near a top end portion of said metal cylinder, said coil antenna element being electrically isolated from said rod antenna element and said metal cylinder;

sliding contact means connected to a tip of said inner conductor and making sliding contact with said rod antenna element; and a contact terminal extending from the tip of said rod antenna element at right angles to its axis and making contact with one end of said coil antenna element when said rod antenna element is retracted in said metal cylinder;

wherein when said rod antenna element is retracted in said metal cylinder, the lower end of said rod antenna element is connected to said core conductor of said feeder.

23. The antenna equipment of claim 22, wherein an insulating guide tube is disposed in said metal cylinder substantially along its center axis, for guiding said rod antenna element inserted thereinto, and wherein said inner conductor is extended over an outer peripheral surface of said tubular insulating guide tube in its axial direction.

24. The antenna equipment of claim 23, wherein said sliding contact means is an annular metal member which holds said rod antenna element inserted thereinto.

25. The antenna equipment of claim 22, wherein said rod antenna element is a tubular element and said inner conductor is an elastic wire disposed along the center axis of said metal cylinder and having a tip inserted in the tubular body of said rod antenna element, said elastic wire sliding in said tubular body of said rod antenna element to guide it when said rod antenna element is retracted in said metal cylinder, and said tip of said elastic wire forming said sliding contact means which makes sliding contact with said rod antenna element in its tubular body.

26. The antenna equipment of claim 20, wherein: said rod antenna element is slidably received in said metal cylinder in its axial direction; said rod antenna element has at its tip a short-circuit portion which contacts said metal cylinder when said rod antenna element is retracted in said metal cylinder; the other end of said second feeder is connected in parallel to said first feeder; and the length of said second feeder is selected such that the impedance at the side of said second feeder, viewed from the connection point of said first and second feeders, is appreciably high when said rod antenna element is extended out from said metal cylinder and low when said rod antenna element is retracted in said metal cylinder.

27. The antenna equipment of claim 20, 22 or 26, wherein that portion of said inner conductor near said feeder is larger in diameter than that portion of said inner conductor near said rod antenna element.

28. The antenna element of claim 20, 22, or 26, wherein the length of said rod antenna element is about one-half the operating wavelength and the length of said metal cylinder in its axial direction is about a quarter of said operating wavelength.

29. The antenna equipment of claim 20, 22, or 26, wherein a capacitor is connected in parallel to the connection point of said first feeder and said coaxial line.

30. The antenna equipment of claim 20, wherein said metal cylinder has a second slit formed therein in its axial direction to form a parasitic slot antenna.

31. The antenna equipment of claim 20, wherein a strip of metal is disposed on an outer peripheral surface of said metal cylinder with a dielectric spacer sandwiched therebetween, said strip of metal extending adjacent but in parallel to said slit.

* * * * *